US011395958B2

(12) United States Patent
Chun

(10) Patent No.: US 11,395,958 B2
(45) **Date of Patent: *Jul. 26, 2022**

(54) GAME OBJECT RANDOMIZATION APPARATUS FOR ELECTRONIC GAMING MACHINE

(71) Applicant: Fresh Idea Global Limited, Hong Kong (HK)

(72) Inventor: Jay Chun, Hong Kong (HK)

(73) Assignee: Fresh Idea Global Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/308,030

(22) Filed: May 4, 2021

(65) Prior Publication Data

US 2021/0252380 A1 Aug. 19, 2021

Related U.S. Application Data

(63) Continuation of application No. 16/877,232, filed on May 18, 2020, now Pat. No. 11,040,273, which is a continuation of application No. 16/167,455, filed on Oct. 22, 2018, now Pat. No. 10,688,383.

(51) Int. Cl.
*A63F 9/04* (2006.01)
*A63F 9/24* (2006.01)

(52) U.S. Cl.
CPC ..... *A63F 9/0406* (2013.01); *A63F 9/0468* (2013.01); *A63F 9/04* (2013.01); *A63F 9/0495* (2013.01); *A63F 2009/0408* (2013.01); *A63F 2009/0411* (2013.01); *A63F 2009/2435* (2013.01)

(58) Field of Classification Search
CPC ..... A63F 2009/0408; A63F 2009/0411; A63F 9/0406; A63F 9/04; A63F 2009/2435; A63F 9/0495; A63F 9/0468
USPC ..... 273/145 CA, 145 D, 145 C, 145 R, 273/145 A, 145 B, 145 E
See application file for complete search history.

(56) References Cited

U.S. PATENT DOCUMENTS

| | | | |
|---|---|---|---|
| 629,672 | A | 7/1899 | Fadum |
| D72,257 | S | 3/1927 | Haunz |

(Continued)

FOREIGN PATENT DOCUMENTS

| | | |
|---|---|---|
| CN | 101244335 | 8/2008 |
| CN | 101513571 | 8/2009 |

(Continued)

OTHER PUBLICATIONS

Office Action for U.S. Appl. No. 13/948,101, dated Dec. 16, 2013.

(Continued)

*Primary Examiner* — Michael D Dennis

(57) ABSTRACT

An improved system, apparatus and method for flipping gaming objects, such as dice, in a random, reliable manner. An object flipping platform can be contained within a container associated with an electronic gaming machine. The container can be at least partially transparent so that users (e.g., game players) are able to view the objects flipping. The object flipping platform can be used to flip objects (e.g., dice) from one side to an opposite side, and vice versa.

18 Claims, 16 Drawing Sheets

(56) References Cited

U.S. PATENT DOCUMENTS 2,044,994 A * 6/1936 Pierce ..... A63F 9/02 273/145 CA
2,302,333 A * 11/1942 Linke ..... A63F 9/0406 273/145 CA
D141,237 S 5/1945 Gauvreau
D150,824 S 9/1948 Buckner
D170,040 S 7/1953 Altemiller
2,831,692 A * 4/1958 Keast ..... A63F 5/04 273/117
3,659,852 A * 5/1972 Redict ..... A63F 9/0406 273/145 C
3,759,524 A * 9/1973 McNaney ..... A63F 5/04 273/142 H
D246,916 S 1/1978 Cheng
D259,847 S 7/1981 Hamby
D268,368 S 3/1983 Moss
D280,477 S 9/1985 Petrick
D283,861 S 5/1986 Cantolino
4,856,787 A 8/1989 Itkis
5,031,913 A * 7/1991 Hirosumi ..... A63F 9/04 273/145 C
D321,614 S 11/1991 Liptak
5,083,271 A 1/1992 Thacher et al.
5,347,061 A 9/1994 Harandi et al.
5,449,174 A * 9/1995 Criner ..... A63F 9/0406 273/145 C
5,472,194 A 12/1995 Breeding et al.
5,605,334 A 2/1997 McCrea
5,707,061 A * 1/1998 Ikeda ..... A63F 9/04 273/145 R
5,707,601 A 1/1998 Ikeda
5,762,552 A 6/1998 Vuong
5,768,382 A 6/1998 Schneier et al.
5,823,873 A 10/1998 Moody
5,851,011 A 12/1998 Lott
5,917,725 A 6/1999 Thacher et al.
5,970,143 A 10/1999 Schneier et al.
6,165,069 A 12/2000 Sines et al.
D438,260 S 2/2001 Isetani
D438,404 S 3/2001 Topper
6,331,148 B1 12/2001 Krause
6,361,044 B1 3/2002 Block
6,394,901 B1 5/2002 Marta
6,508,709 B1 1/2003 Karmarkar
6,652,378 B2 11/2003 Cannon
6,671,358 B1 12/2003 Seidman et al.
6,886,829 B2 5/2005 Hessing et al.
6,991,544 B2 1/2006 Soltys et al.
7,008,322 B1 3/2006 Suzuki et al.
7,040,982 B1 5/2006 Jarvis
D539,854 S 4/2007 Luciano
7,206,762 B2 4/2007 Sireau
7,233,922 B2 6/2007 Asher
D546,596 S 7/2007 McDermott
D557,348 S 12/2007 Gutknecht
7,553,233 B2 6/2009 Jarvis et al.
D596,678 S 7/2009 Myers
7,566,268 B2 7/2009 Asher
7,566,270 B2 7/2009 Amaitis
7,604,537 B2 10/2009 Amaitis
7,637,506 B2 12/2009 Naicker
7,684,874 B2 3/2010 Schlottmann et al.
7,690,996 B2 4/2010 Iddings et al.
D615,319 S 5/2010 Tuszkiewicz
7,711,628 B2 5/2010 Davie
7,727,060 B2 6/2010 Mills
7,731,586 B2 6/2010 Letovsky et al.
7,783,542 B2 8/2010 Horowitz
7,783,552 B2 8/2010 Assia
7,798,895 B2 9/2010 Jubinville et al.
D641,427 S 7/2011 Lin
D645,910 S 9/2011 Foster
8,052,526 B2 11/2011 Abbott et al.
8,070,583 B2 12/2011 Baerlocher et al.
8,150,157 B2 4/2012 Downs et al.
8,257,166 B2 9/2012 Kido
8,262,090 B2 9/2012 Soltys et al.
8,272,892 B2 9/2012 Mcneely
8,282,489 B2 10/2012 Azerina et al.
8,348,278 B2 1/2013 Tseng
8,444,148 B1 5/2013 Tseng
8,469,788 B2 6/2013 Carpenter et al.
8,590,895 B2 11/2013 Kwon
8,684,830 B1 4/2014 Chun
8,808,077 B1 8/2014 Chun
8,920,229 B1 12/2014 Chun
9,292,996 B2 3/2016 Davis et al.
9,311,773 B2 4/2016 Chun
9,345,956 B2 * 5/2016 MacDonald ..... A63F 11/0011
9,449,461 B1 9/2016 Barksdale
9,592,450 B2 3/2017 Chun
9,595,166 B2 3/2017 Chun
9,779,580 B2 10/2017 Jones
9,858,752 B2 1/2018 Montgomery
9,931,562 B2 4/2018 Chun
9,940,782 B2 4/2018 Chun
RE46,826 E 5/2018 Hill
10,013,847 B2 7/2018 Chun
10,147,269 B2 12/2018 Chun
D852,890 S 7/2019 Ross
10,688,383 B2 6/2020 Chun
11,040,273 B2 * 6/2021 Chun ..... A63F 9/0468
2002/0002073 A1 1/2002 Montgomery
2002/0094869 A1 7/2002 Harkham
2002/0147042 A1 10/2002 Shinners et al.
2002/0151366 A1 10/2002 Walker et al.
2003/0070178 A1 4/2003 Boyd
2003/0137110 A1 7/2003 Huard et al.
2003/0195841 A1 10/2003 Ginsberg
2004/0121839 A1 6/2004 Web
2004/0152498 A1 8/2004 Kaminkow
2004/0204232 A1 10/2004 Asher
2005/0043094 A1 2/2005 Nguyen et al.
2005/0165669 A1 7/2005 Montanaro
2005/0197938 A1 9/2005 Davie
2005/0197948 A1 9/2005 Davie
2006/0025221 A1 2/2006 Jain
2006/0058082 A1 3/2006 Crawford et al.
2006/0058083 A1 3/2006 Crawford et al.
2006/0058084 A1 3/2006 Crawford et al.
2006/0058085 A1 3/2006 White et al.
2006/0058086 A1 3/2006 White et al.
2006/0058087 A1 3/2006 White et al.
2006/0058088 A1 3/2006 Crawford et al.
2006/0058089 A1 3/2006 White et al.
2006/0058090 A1 3/2006 Crawford et al.
2006/0058091 A1 3/2006 Crawford et al.
2006/0058092 A1 3/2006 Crawford et al.
2006/0058093 A1 3/2006 White et al.
2006/0066052 A1 3/2006 White et al.
2006/0068498 A1 3/2006 White et al.
2006/0068864 A1 3/2006 White et al.
2006/0068865 A1 3/2006 White et al.
2006/0068866 A1 3/2006 White et al.
2006/0068868 A1 3/2006 Crawford et al.
2006/0068869 A1 3/2006 White et al.
2006/0068870 A1 3/2006 Crawford et al.
2006/0068871 A1 3/2006 Crawford et al.
2006/0068879 A1 3/2006 Crawford et al.
2006/0068899 A1 3/2006 White et al.
2006/0094493 A1 5/2006 Kido
2006/0100019 A1 5/2006 Hornik et al.
2006/0105839 A1 5/2006 Graeve
2006/0217199 A1 9/2006 Adcox et al.
2006/0264252 A1 11/2006 White et al.
2006/0287066 A1 12/2006 Crawford et al.
2006/0287067 A1 12/2006 White et al.
2006/0287097 A1 12/2006 Moshal
2006/0287101 A1 12/2006 Crawford et al.
2006/0287102 A1 12/2006 White et al.
2006/0287103 A1 12/2006 Crawford et al.
2006/0287104 A1 12/2006 White et al.
2007/0015583 A1 1/2007 Tran

(56) References Cited

U.S. PATENT DOCUMENTS

2007/0032283 A1 2/2007 Chun
2007/0060259 A1 3/2007 Pececnik
2007/0087832 A1 4/2007 Abbott et al.
2007/0090595 A1 4/2007 Csikos
2007/0129138 A1 6/2007 Amaitis
2007/0178955 A1 8/2007 Mills
2007/0259709 A1 11/2007 Kelly et al.
2008/0045344 A1 2/2008 Schlottmann et al.
2008/0081685 A1 4/2008 Naftaly
2008/0102916 A1 5/2008 Kovacs
2008/0108404 A1 5/2008 Iddings et al.
2008/0108436 A1 5/2008 Oberberger
2008/0113767 A1 5/2008 Nguyen et al.
2008/0153571 A1 6/2008 Okada
2008/0200242 A1 8/2008 Ginsberg
2008/0220837 A1 9/2008 Yoshizawa
2008/0248849 A1 10/2008 Lutnick et al.
2008/0248864 A1 10/2008 Toyoda
2008/0318651 A1 12/2008 Gross
2009/0005165 A1 1/2009 Arezina
2009/0121434 A1 5/2009 Baerlocher
2009/0124323 A1 5/2009 Dunn et al.
2009/0131151 A1 5/2009 Harris et al.
2009/0189351 A1 7/2009 Baerlocher
2009/0197676 A1 8/2009 Baerlocher
2009/0215529 A1* 8/2009 Inamura ..... G07F 17/3213 463/25
2009/0275376 A1 11/2009 Anderson
2009/0280904 A1 11/2009 Nicely et al.
2009/0291762 A1 11/2009 Walter
2009/0325686 A1 12/2009 Davis et al.
2010/0087241 A1 4/2010 Nguyen et al.
2010/0150460 A1 4/2010 Makhoul et al.
2010/0234089 A1 9/2010 Saffari
2010/0234099 A1 9/2010 Rasmussen
2010/0331085 A1 12/2010 Nagano
2011/0018194 A1* 1/2011 Nicely ..... A63F 9/0406 273/145 CA
2011/0111833 A1 5/2011 Nordahl
2011/0294561 A1 12/2011 Shaw et al.
2011/0300917 A1 12/2011 Hill
2012/0049447 A1 3/2012 Klein
2012/0049455 A1 3/2012 Yap et al.
2012/0083909 A1 4/2012 Carpenter et al.
2012/0122564 A1 5/2012 Kovacs
2012/0214575 A1 8/2012 Amaitis et al.
2012/0252564 A1 10/2012 Moore et al.
2012/0264496 A1 10/2012 Behrman
2012/0329551 A1 12/2012 Arerina et al.
2013/0005456 A1 1/2013 Okujo et al.
2013/0079147 A1 3/2013 Merati
2013/0116031 A1 5/2013 Carpenter et al.
2013/0134672 A1 5/2013 Okuaki
2013/0225276 A1 8/2013 Au-Yeung
2013/0244765 A1 9/2013 Arnone et al.
2013/0260863 A1 10/2013 Lee
2013/0281197 A1 10/2013 Carpenter et al.
2013/0288764 A1 10/2013 Chun
2013/0288779 A1 10/2013 Chun
2013/0296031 A1 11/2013 Arnone et al.
2013/0341862 A1 12/2013 Tokue
2014/0094256 A1 4/2014 Hilbert
2014/0094298 A1 4/2014 Lyons
2014/0162758 A1 6/2014 Pececnik
2014/0187306 A1 7/2014 Nordahl
2014/0256392 A1 9/2014 Jones
2014/0256411 A1 9/2014 Basallo
2014/0274252 A1 9/2014 Chun
2014/0274253 A1 9/2014 Chun
2014/0312567 A1 10/2014 Chun
2015/0019744 A1 1/2015 Bourenkov
2015/0024818 A1 1/2015 Chun
2015/0116410 A1 4/2015 Armbruster
2015/0161851 A1* 6/2015 Naicker ..... G07F 17/326 463/22
2015/0332552 A1 11/2015 Chun
2016/0292954 A1 10/2016 Sugai et al.
2017/0161988 A1 6/2017 Nguyen
2017/0161993 A1 6/2017 Nguyen
2018/0315272 A1 11/2018 Chun

FOREIGN PATENT DOCUMENTS

CN 102580306 7/2012
EP 1939826 A2 7/2008
TW 201138907 A1 11/2011

OTHER PUBLICATIONS

Cantor Fitzgerald Hopes to Bring Spread Betting to Las Vegas Casinos, Dec. 14, 2009.
Financial Spread Betting, Apr. 26, 2012.
High-Speed Traders Set Their Sights on Asia and Latin America, Aug. 12, 2010.
Office Action for U.S. Appl. No. 13/456,110, dated Jun. 11, 2013.
Final Office Action for U.S. Appl. No. 13/456,110, dated Dec. 24, 2013.
Office Action for U.S. Appl. No. 14/017,071, dated Nov. 7, 2013.
Notice of Allowance for U.S. Appl. No. 14/017,071, dated Jan. 24, 2014.
Office Action for U.S. Appl. No. 14/017,073, dated Dec. 10, 2013.
Final Office Action for U.S. Appl. No. 13/948,101, dated Apr. 23, 2014.
Notice of Allowance for U.S. Appl. No. 14/017,073, dated May 20, 2014.
Office Action for U.S. Appl. No. 14/095,882, dated Aug. 14, 2014.
Office Action for U.S. Appl. No. 13/456,110, dated Sep. 12, 2014.
Office Action for U.S. Appl. No. 13/542,446, dated Sep. 10, 2014.
Office Action for U.S. Appl. No. 14/197,683, dated Aug. 4, 2014.
Office Action for U.S. Appl. No. 14/174,701, dated Mar. 12, 2015.
Final Office Action for U.S. Appl. No. 13/542,446, dated Mar. 25, 2015.
Final Office Action for U.S. Appl. No. 13/456,110, dated Apr. 22, 2015.
Office Action for U.S. Appl. No. 13/456,110, dated Jan. 13, 2016.
Final Office Action for U.S. Appl. No. 13/542,446, dated Jan. 4, 2016.
Office Action for U.S. Appl. No. 15/094,827, dated Sep. 22, 2016.
Notice of Allowance for U.S. Appl. No. 13/456,110, dated Nov. 16, 2016.
Notice of Allowance for U.S. Appl. No. 13/542,446, dated Nov. 16, 2016.
Office Action for U.S. Appl. No. 14/692,623, dated Oct. 5, 2016.
Office Action for U.S. Appl. No. 14/318,426, dated Sep. 11, 2015.
Notice of Allowance for U.S. Appl. No. 14/318,426, dated Dec. 8, 2015.
Office Action for U.S. Appl. No. 14/508,922, dated Jan. 30, 2017.
Final Office Action for U.S. Appl. No. 14/692,623, dated Mar. 24, 2017.
Notice of Allowance for U.S. Appl. No. 14/692,623, dated Jun. 30, 2017.
Restriction Requirement for U.S. Appl. No. 14/692,623, dated Sep. 6, 2016.
Office Action for U.S. Appl. No. 15/094,827, dated Sep. 13, 2017.
SIPO of People's Republic of China, Examiner's Report and International Search Report for Macau Patent Application No. I-1385 dated May 26, 2017(with partial Translation).
Notice of Allowance for U.S. Appl. No. 14/692,623, dated Nov. 29, 2017.
Final Office Action for U.S. Appl. No. 15/441,182, dated Mar. 16, 2018.
Notice of Allowance for U.S. Appl. No. 15/094,827, dated Apr. 4, 2018.
Notice of Allowance for U.S. Appl. No. 15/691,738, dated May 23, 2018.
Office Action for U.S. Appl. No. 14/929,240, dated Jun. 1, 2018.
Office Action for U.S. Appl. No. 15/231,693, dated Jun. 22, 2018.
Office Action for U.S. Appl. No. 15/943,661, dated Jun. 29, 2018.

(56) References Cited

OTHER PUBLICATIONS

Office Action for U.S. Appl. No. 15/666,486 dated Jul. 27, 2018.
Office Action for U.S. Appl. No. 14/508,922, dated Aug. 31, 2018.
Office Action for U.S. Appl. No. 15/441,184, dated Jul. 3, 2018.
Final Office Action for U.S. Appl. No. 14/929,240, dated Dec. 12, 2018.
Final Office Action for U.S. Appl. No. 15/666,486, dated Dec. 31, 2018.
Office Action for U.S. Appl. No. 14/929,240, dated Apr. 5, 2019.
Final Office Action for U.S. Appl. No. 14/508,922, dated May 2, 2019.
Office Action for U.S. Appl. No. 15/666,486, dated Jun. 5, 2019.
Office Action for U.S. Appl. No. 16/167,455, dated Jun. 14, 2019.
Notice of Allowance for U.S. Appl. No. 16/025,994, dated Jun. 26, 2019.
Notice of Allowance for U.S. Appl. No. 14/929,240, dated Sep. 4, 2019.
Office Action for Design U.S. Appl. No. 29/667,500, dated Sep. 11, 2019.
Final Office Action for U.S. Appl. No. 15/666,486, dated Nov. 27, 2019.
Final Office Action for U.S. Appl. No. 14/508,922, dated Dec. 6, 2019.
Advisory Action for U.S. Appl. No. 15/666,486, dated Mar. 17, 2020.
Office Action for U.S. Appl. No. 15/666,486, dated Jun. 12, 2020.
Office Action for U.S. Appl. No. 16/735,685, dated Oct. 2, 2020.
Office Action for U.S. Appl. No. 15/666,486, dated Nov. 5, 2020.
Office Action for U.S. Appl. No. 16/877,232, dated Nov. 27, 2020.
Final Office Action for U.S. Appl. No. 16/735,685, dated Jan. 12, 2021.

* cited by examiner

GAME OBJECT RANDOMIZATION APPARATUS FOR ELECTRONIC GAMING MACHINE

CROSS-REFERENCE TO RELATED APPLICATIONS

This application is a continuation of U.S. patent application Ser. No. 16/877,232, entitled "GAMING OBJECT FLIPPING APPARATUS FOR ELECTRONIC GAMING MACHINE," filed on May 18, 2020, and which is hereby incorporated herein by reference, and which in turn is a continuation of U.S. patent application Ser. No. 16/167,455, entitled "GAMING OBJECT FLIPPING APPARATUS FOR ELECTRONIC GAMING MACHINE," filed on Oct. 22, 2018, and which is hereby incorporated herein by reference.

BACKGROUND OF THE INVENTION

Today, gaming establishments, such as casinos, operate gaming apparatus, such as gaming tables that provide casino table games. Casino table games, such as Poker, Roulette, Black Jack, Craps, SicBo, Baccarat, etc., often involve players sitting at a physical table using physical game objects (cards, dice, chips, etc.) to play the games.

These gaming tables are typically administered by human dealers and are played on physical gaming tables having a dealer surface for supporting the game objects, such as cards, dice, chips and the like. Alternatively, such table games can be played in connection with electronic gaming machines where the dealer, playing cards, chips or other gaming elements are physically administered separately from such machines. Other wagering games can also be played entirely on electronic gaming machines. For example, such electronic gaming machines include slot machines as well as video poker, video keno, video blackjack, and the like. Many players like the anonymity and individualized nature of playing such machines alone or away from the crowds that are often attracted to convention physical table games.

While gaming machines, gaming tables, and systems therefor have worked well in practice over many years, there is always a desire for improvement. In particular, there is a need for improved electronic gaming machines that are able to provide table game elements to players who might prefer to play at an individual electronic gaming machine.

SUMMARY

An improved system, apparatus and method for flipping gaming objects, such as dice, in a random, reliable manner are disclosed. An object flipping platform can be contained within a container associated with an electronic gaming machine. The container can be at least partially transparent so that users (e.g., game players) are able to view the objects, even during flipping. The object flipping platform can be used to flip objects (e.g., dice) from one side to an opposite side, and vice versa. In one implementation, the container and the object flipping platform can have an elongated or oblong configuration.

In one embodiment, the container can also include one or more cameras and/or one or more light sources. The one or more cameras can be used to capture images of the dice or any other objects in the container. For example, in one embodiment, the die values, after the dice have been flipped, may be determined using image recognition. The one or more light sources can be used to illuminate the container for appearance and/or to provide visual notification to players. In one embodiment, the visual notification can indicate the die values and/or a situation of interest to player. For example, if two die values both have the same value, the one or more light sources may flash a predetermined number of times, illuminate in a different color, or flash in a pattern to inform the players that a double was rolled. In one embodiment, the container can also include one or more speakers that can provide an audible notification of the die values and/or a situation of interest to a player.

The dice flipping serves to randomize the gaming objects that can be used for wager-based games using an electronic gaming machine. In one implementation, the wager-based game can mimic a table game that makes use of physical objects in carrying out a wager-based game. The gaming objects can be used in the wager-based games to provide different potential outcomes. The particular potential outcome yielded by the gaming objects is randomized by the flipping action using the dice flipping platform.

In one embodiment, the dice flipping platform can be controlled to cause dice settled at a first side, to be flipped towards a second (opposite) side. Once flipped, the dice land back on the dice flipping platform and settle on the second side. Hence, the flipping induced by the control of the dice flipping portion is from the first side to the second side. However, in the next flip of the dice, the dice settled at the second side are then flipped towards the first (opposite) side. Regardless of which direction the flipping occurs, the dice can be reliably and randomly flipped with an airborne flip.

In another embodiment, the gaming objects (e.g., dice) can be moved (e.g., rolled) from one side of the dice flipping platform to the other. Hence, in this embodiment, no flipping is required and the dice flipping platform can be referred to more generally as a gaming object randomizing platform.

The invention can be implemented in numerous ways, including as a method, system, device, apparatus (including computer readable medium and graphical user interface). Several embodiments of the invention are discussed below.

As gaming object randomization apparatus, one embodiment of the invention can, for example, include at least: a container configured to contain one or more gaming objects, the container having a top portion, a bottom portion and a plurality of sides, at least a substantial portion of at least one of the sides being transparent, the container containing a randomization structure; and an actuator mechanically coupled to the randomization structure. The randomization structure includes a unitary platform having a first end portion, a central portion and a second end portion, with the first end portion being fixed at an upward angle relative to the central portion, and the second end portion being fixed at an upward angle relative to the central portion. In one embodiment, the one or more gaming objects settle at only either of the first end portion or the second end portion of the platform which are opposing sides of the platform.

As a dice flipping apparatus, one embodiment of the invention can, for example, include at least: a container configured to contain dice, the container having a top portion, a bottom portion and a plurality of sides, at least a substantial portion of at least one of the sides being transparent, the container containing a flipping structure; an actuator mechanically coupled to the flipping structure; a light source provided in the top portion of the container; and a camera provided in the top portion of the container. The flipping structure can include a platform having a first end portion, a central portion and a second end portion, where the first end portion can be angled upward relative to the central portion and the second end portion can be angled upward relative to the central portion. In one embodiment, the dice settle at only either of the first end portion or the second end portion of the platform which are at opposing sides of the platform.

As a gaming device, one embodiment of the invention can, for example, include at least: a game console providing a user interface for game play, the user interface including a display region that displays one or more gaming object values; and a gaming object randomization apparatus coupled to the game console. The gaming object randomization apparatus can include at least: a container configured to contain one or more gaming objects, the container having a top portion, a bottom portion and a plurality of sides. The container can contain a randomization structure, and an actuator mechanically coupled to the randomization structure. The randomization structure can include a unitary platform, the platform can have a first end portion, a central portion and a second end portion, with the first end portion being permanently angled upward relative to the central portion, and with the second end portion being permanently angled upward relative to the central portion. The one or more gaming object settle at either of the first end portion or the second end portion of the platform, the first end portion and the second end portion being at opposing sides of the platform. The actuator is configured to induce a randomization action to move the platform of the randomization structure to cause the one or more gaming objects to rotate in the container in a first direction from the first end portion to settle at the second end portion, or alternatively in a second direction from the second end portion to settle at the first end portion.

As another gaming device, one embodiment of the invention can, for example, include at least: a game console providing a user interface for game play, the user interface including a display region that displays dice values; and a dice flipping apparatus coupled to the game console. The dice flipping apparatus can include at least: a container configured to contain dice, and an actuator mechanically coupled to the dice flipping apparatus. The container can have a top portion, a bottom portion and a plurality of sides, with at least a substantial portion of at least one of the sides being transparent. The container can contain a flipping structure. The flipping structure can include a platform. The platform can have a first end portion, a central portion and a second end portion, the first end portion can be angled upward relative to the central portion, and the second end portion can be angled upward relative to the central portion. The dice settle at only either of the first end portion or the second end portion of the platform, the first end portion and the second end portion being at opposing sides of the platform.

As a gaming object randomizing apparatus, one embodiment of the invention can, for example, include at least a container configured to contain gaming objects and an actuator. The container can have a top portion, a bottom portion and a plurality of sides, at least a substantial portion of at least one of the sides being transparent. The container can also contain a flipping structure. The actuator can be mechanically coupled to the flipping structure. The flipping structure can include a platform having a first end portion, a central portion and a second end portion. The flipping structure can be configured such that the gaming objects settle at either the first end portion or the second end portion of the platform, the first end and the second end portions being at opposing sides of the platform.

As a dice flipping apparatus, one embodiment of the invention can, for example, include at least a container configured to contain dice and an actuator. The container can have a top portion, a bottom portion and a plurality of sides, with at least a substantial portion of at least one of the sides being transparent. The container can also contain a flipping structure. The actuator can be mechanically coupled to the flipping structure. The flipping structure can include a platform having a first end portion, a central portion and a second end portion. The first end portion of the platform can be angled upward relative to the central portion, and the second end portion of the platform can be angled upward relative to the central portion. The flipping structure can also be configured such that the dice settle at either the first end portion or the second end portion of the platform, where the first end and the second end portions are at opposing sides of the platform.

As a method of randomizing a set of dice, one embodiment of the invention can, for example, include at least: receiving a dice flip request; inducing a flip action to flip the dice based at least in part on the dice flip request; permitting the dice to settle following the flip action; acquiring at least one image of the dice as settled following the flip action; and determining dice values from the at least one image of the dice.

As a method of randomizing one or more gaming objects, one embodiment of the invention can, for example, include at least: receiving a gaming object randomize request; inducing a randomization action to the one or more gaming objects based at least in part on the gaming object randomize request; permitting the one or more gaming objects to settle following the randomization action; acquiring at least one image of the one or more gaming objects as settled following the randomization action; determining one or more gaming object values from the at least one image of the one or more gaming objects; and causing the one or more gaming object values to be displayed on a display device.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like elements, and in which.

DETAILED DESCRIPTION OF CERTAIN EMBODIMENTS

Figure 1:
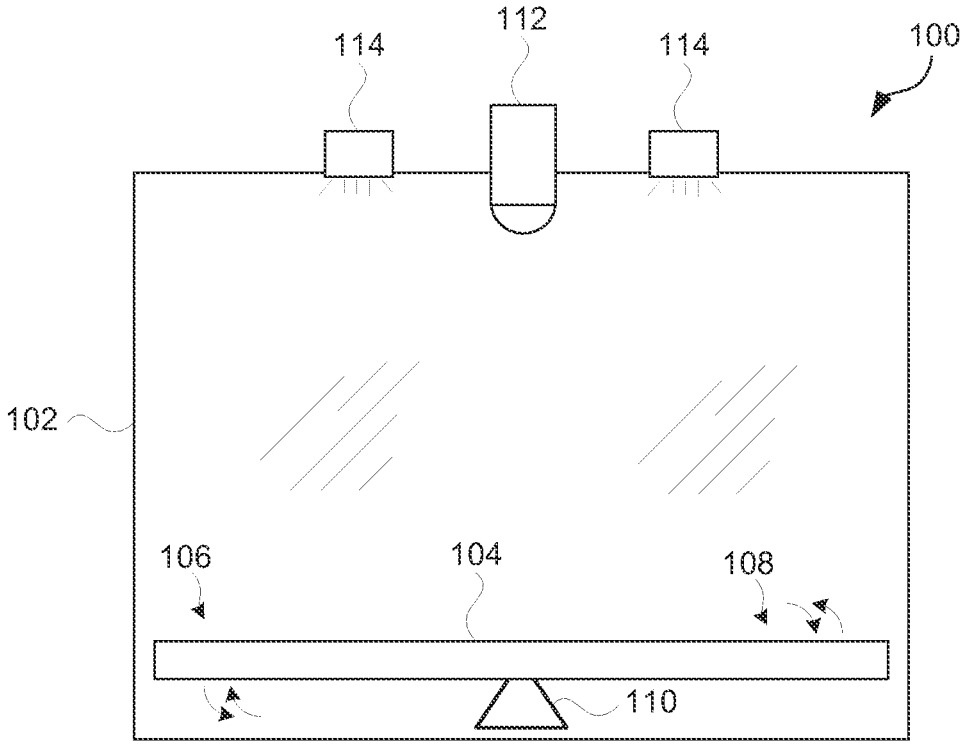
FIG. 1 illustrates a front view of a dice flipping apparatus according to one embodiment.

An improved system, apparatus and method for flipping gaming objects, such as dice, in a random, reliable manner are disclosed. An object flipping platform can be contained within a container associated with an electronic gaming machine. The container can be at least partially transparent so that users (e.g., game players) are able to view the objects, even during flipping. The object flipping platform can be used to flip objects (e.g., dice) from one side to an opposite side, and vice versa.

In one implementation, the container and the object flipping platform can have an elongated or oblong configuration. In another implementation, the container and the object flipping platform can have a round or circular configuration. In still another implementation, the container and the object flipping platform can have a square (e.g., rounded square) configuration. Although the embodiments described depicted below are principally elongated or oblong, it should be understood that various other shapes or configurations can be used.

In one embodiment, the container can also include one or more cameras and/or one or more light sources. The one or more cameras can be used to capture images of the dice or any other objects in the container. For example, in one embodiment, the die values, after the dice have been flipped, may be determined using image recognition. The one or more light sources can be used to illuminate the container for appearance and/or to provide visual notification to players. In one embodiment, the visual notification can indicate the die values and/or a situation of interest to player. For example, if two die values both have the same value, the one or more light sources may flash a predetermined number of times, illuminate in a different color, or flash in a pattern to inform the players that a double was rolled. In one embodiment, the container can also include one or more speakers that can provide an audible notification of the die values and/or a situation of interest to a player.

The dice flipping serves to randomize the gaming objects that can be used for wager-based games using an electronic gaming machine. In one implementation, the wager-based game can mimic a table game that makes use of physical objects in carrying out a wager-based game. The gaming objects can be used in the wager-based games to provide different potential outcomes. The particular potential outcome yielded by the gaming objects is randomized by the flipping action using the dice flipping platform.

In one embodiment, the dice flipping platform can be controlled to cause dice, settled at a first side, to be flipped towards a second (opposite) side. Once flipped, the dice land back on the dice flipping platform and settle on the second side. Hence, the flipping induced by the control of the dice flipping portion is from the first side to the second side. However, in the next flip of the dice, the dice settled at the second side are then flipped towards the first (opposite) side. Regardless of which direction the flipping occurs, the dice can be reliably and randomly flipped with an airborne flip.

In another embodiment, the gaming objects (e.g., dice) can be moved (e.g., rolled) from one side of the dice flipping platform to the other. Hence, in this embodiment, no flipping is required and the dice flipping platform can be referred to more generally as a gaming object randomizing platform.

Embodiments of various aspects of the invention are discussed below with reference to FIGS. 1-10. However, those skilled in the art will readily appreciate that the detailed description given herein with respect to these figures is for explanatory purposes as the invention extends beyond these limited embodiments.

Various embodiments to devices, systems and methods for providing, conducting and facilitating play of wagering games (or chance games) at personalized or individualized interactive electronic table gaming machines can be implemented. Such gaming machines or devices can mimic use of live physical table game components in a self-contained and individualized manner, while using physical table game components (e.g., dice, cards, balls, wheels, and the like). As such, this disclosure may be applied to the individualized machine implementation of any live table game, such as Baccarat, Blackjack, Roulette, Craps, Pai Gow, SicBo, Poker, Bingo, Keno, card games, and the like, as well as any other type of table game having physical components that result in game outcomes. The various embodiments disclosed herein can be applied with respect to individual gaming machines, entire systems involving multiple gaming machines, and methods of operating games on such machines and systems.

FIG. 1 illustrates a front view of a dice flipping apparatus 100 according to one embodiment. The dice flipping apparatus 100 includes a container 102. Within the container is a flipping structure 104 having a first end 106 and a second end 108. The flipping structure 104 is mounted on a pivot structure 110. During operation, the flipping structure 104 can operate to flip gaming objects, such as dice, from either the first end 106 through the air to the second end 108 or from the second end 108 through the air to the first end 106. The flipping of the gaming objects serves to randomize the gaming objects (e.g., dice values). At least a front side of the container 102 is substantially transparent. As a result, as illustrated in FIG. 1, the flipping structure 104 and any flipping of the gaming objects are visible through the front side of the container 102.

In addition, the dice flipping apparatus 100 can also include at least one camera 112 and/or one or more light sources 114. In one implementation, the at least one camera 112 and/or the one or more light sources 114 can be provided in an upper or top portion of the dice flipping apparatus 100. The at least one camera 112 can be used to acquire images of the gaming objects, such as when the gaming objects have settled at either the first end 106 or the second end 108 of the flipping structure 104. The one or more light sources 114 can be used to provide illumination to the upper or top portion of the container 102 or an internal area of the container 102 (such as to illuminate the flipping structure 104 and gaming objects thereon), or both.

Figure 2:
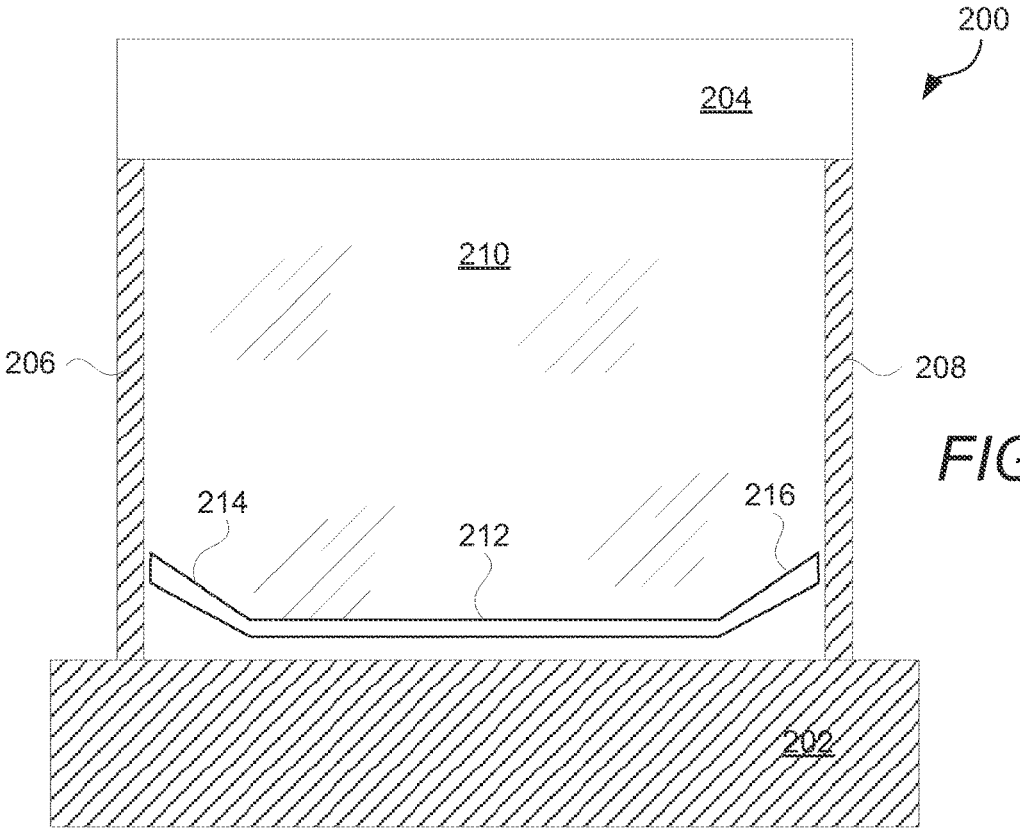
FIG. 2 illustrates a front view of a dice flipping apparatus according to another embodiment.

FIG. 2 illustrates a front view of a dice flipping apparatus 200 according to another embodiment. The dice flipping apparatus 200 includes a bottom structure 202, a top structure 204, a first side 206 and a second side 208. The bottom structure 202 can be part of the dice flipping apparatus 200 or, alternatively, can be associated with another apparatus to which the dice flipping apparatus 200 is being attached.

The dice flipping apparatus 200 forms a container. The front surface of the container is bounded by the bottom structure 202, the top structure 204, the first side 206 and the second side 208. The front surface of the container also has a transparent front side 210. A rear side of the container is not shown but can be transparent, translucent or non-transparent.

Within the container is a flipping structure 212. Since the front side 210 of the container is transparent, the flipping structure 212 is visible through the front side 210. The flipping structure 212 includes a first end portion 214 and a second end portion 216 that are on opposite sides of the flipping structure 212. The first end portion 214 is angled upward or inward with respect to a central portion of the flipping structure. Likewise, the second end portion 216 is angled upward or inward with respect to the central portion of the flipping structure. In one implementation, the flipping structure 212 is generally oblong and the cross-section of the container.

Figure 3A:
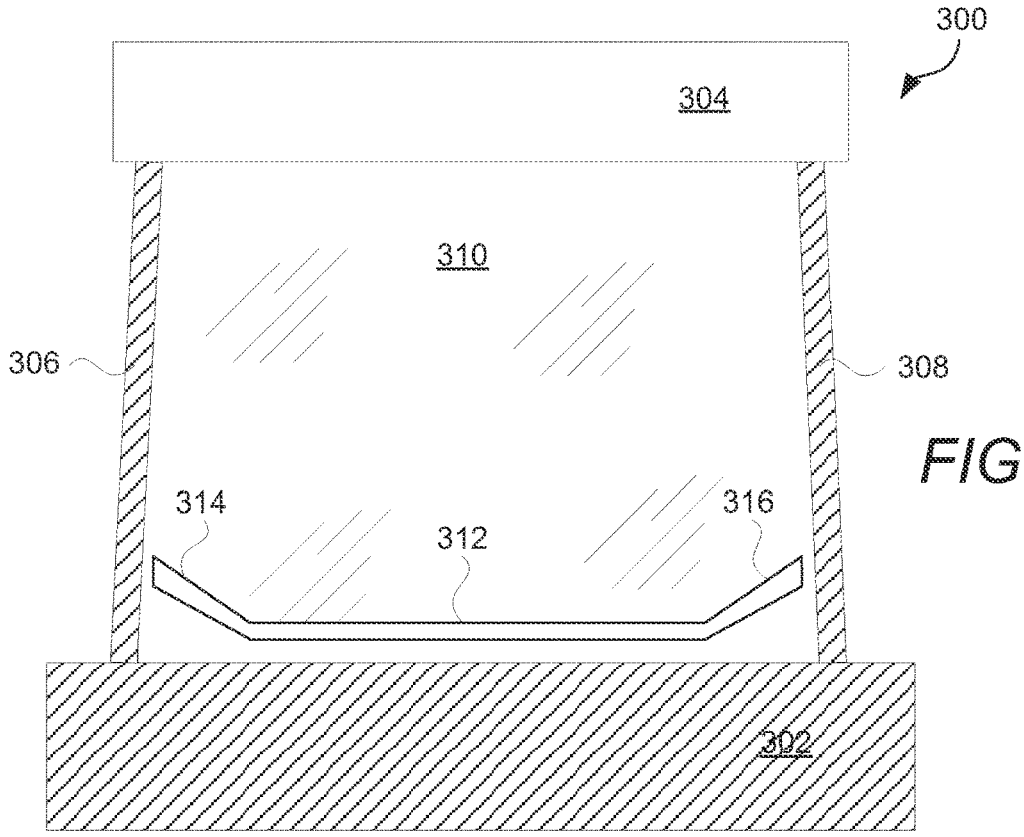
FIGS. 3A-3C illustrate front views of a dice flipping apparatus according to still another embodiment.

FIG. 3A illustrates a front view of a dice flipping apparatus 300 according to still another embodiment. The dice flipping apparatus 300 includes a bottom structure 302, a top structure 304, a first side 306 and a second side 308. The bottom structure 302 can be part of the dice flipping apparatus 300 or, alternatively, can be associated with another apparatus to which the dice flipping apparatus 300 is being attached.

The dice flipping apparatus 300 forms a container. The front surface of the container is bounded by the bottom structure 302, the top structure 304, the first side 306 and the second side 308. The front surface of the container also has a transparent front side 310. A rear side of the container is not shown but can be transparent or non-transparent. As shown in FIG. 3A, the container can be tapered inward from the bottom portion to the top portion, and the first side 306 and the second side 308 can also be tapered inward.

Within the container is a flipping structure 312. Since the front side 310 of the container is transparent, the flipping structure 312 is visible through the front side 310. The flipping structure 312 includes a first end portion 314 and a second end portion 316 that are on opposite sides of the flipping structure 312. The first end portion 314 is angled upward or inward with respect to a central portion of the flipping structure. Likewise, the second end portion 316 is angled upward or inward with respect to the central portion of the flipping structure. In one implementation, the flipping structure 312 is generally oblong as is the cross-section of the container.

The tapering of the container can facilitate the edges of the first end portion 314 and the second end portion 316 being and remaining tightly adjacent the opposing sides of the container. The first side 306 and the second side 308 are also correspondingly tapered inward. Advantageously, the tapering of the container is such that the dice remain on or above the flipping structure 312 since there are unable to pass between the edges of the first end portion 314 and the second end portion 316 and the opposing sides of the container. In one embodiment, the edges of the first and second portions 314, 316 can have elevated edges that extend upward.

Optionally, the edges of the first end portion 314 and the second end portion 316 can be raised upward. The raised edges can be provide a lip. In one implementation, a first raised edge can extend upward and is provided adjacent a corresponding one of the sides of the container, and a second raised edge can extend upward and is provided adjacent another corresponding one of the sides of the container.

Figure 3B:
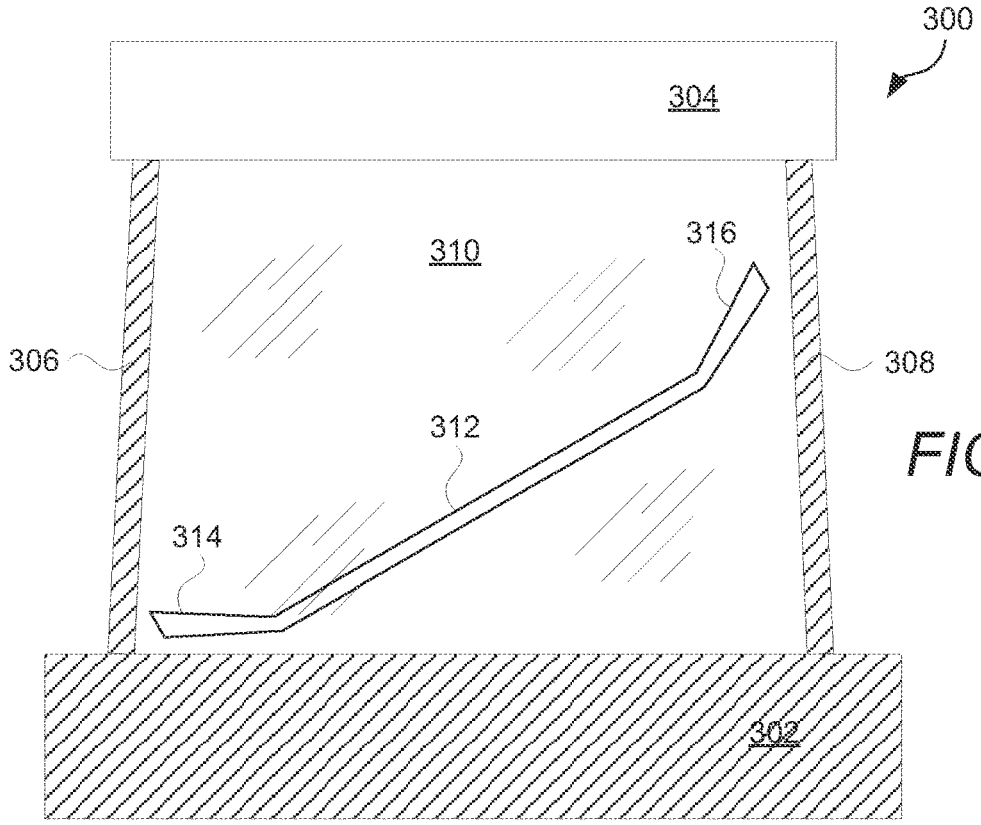

FIG. 3B illustrates a front view of the dice flipping apparatus 300 shown in FIG. 3A after the flipping structure 312 within the container has flipped dice from the second end portion 316 to the first end portion 314.

Figure 3C:
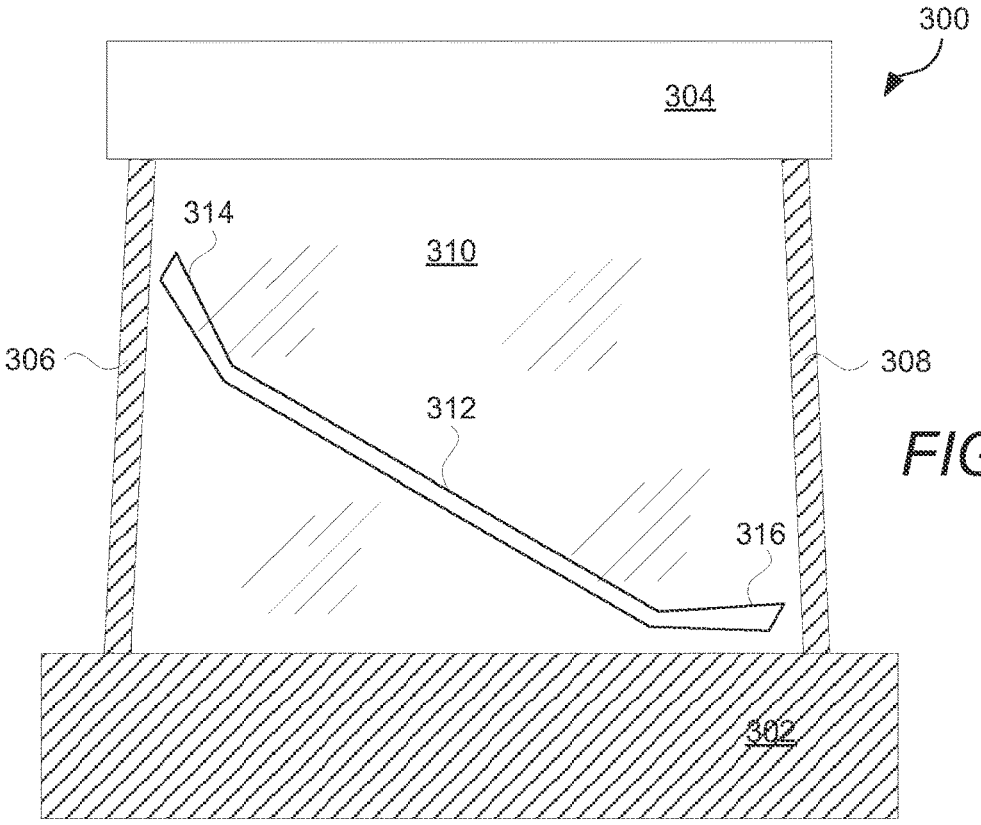

FIG. 3C illustrates a front view of the dice flipping apparatus 300 shown in FIG. 3A after the flipping structure 312 within the container has flipped dice from the first end portion 314 to the second end portion 316.

Figure 3D:
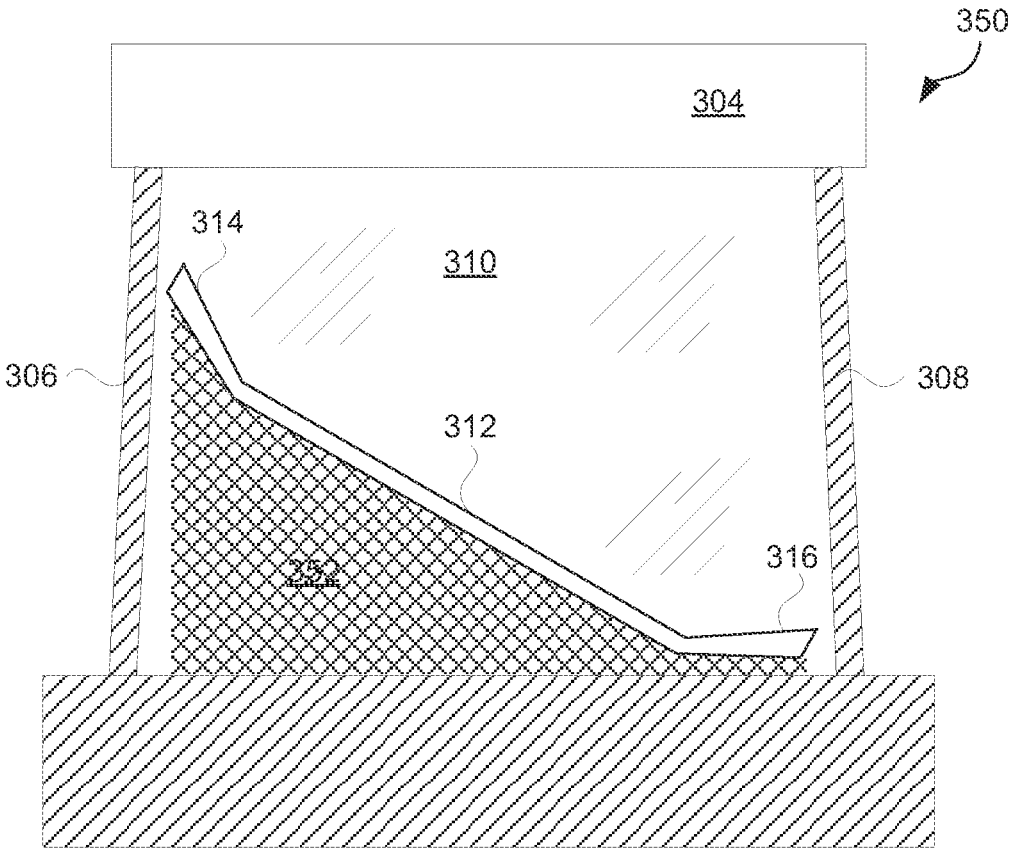
FIG. 3D illustrates a front view of a dice flipping apparatus according to yet still another embodiment.

FIG. 3D illustrates a front view of a dice flipping apparatus 350 according to yet still another embodiment. The dice flipping apparatus 350 is generally similar to the dice flipping apparatus 300 shown in FIG. 3A, but further include a camouflage element 352 that is provided below the flipping structure 312 and serves to camouflage any mechanical structures (e.g., for movement of the flipping structure 312) from being visible from a user of either the dice flipping apparatus 350 or another apparatus to which the dice flipping apparatus 350 is attached. In one implementation, the camouflage element 352 can be deformable and typically light weight to expand or contract as the flipping structure 312 moves. For example, in this implementation, the camouflage element 352 can be formed of a fabric, a polymer (e.g., deformable plastic sheet), paper, etc. In another implementation, the camouflage element 352 can be rigid or semi-rigid but able to expand or contract as the flipping structure 312 moves. For example, in this implementation, the camouflage element 352 can be formed of a metal (e.g., metal sheet) or plastic (e.g., rigid plastic sheet), etc.

Figure 4:
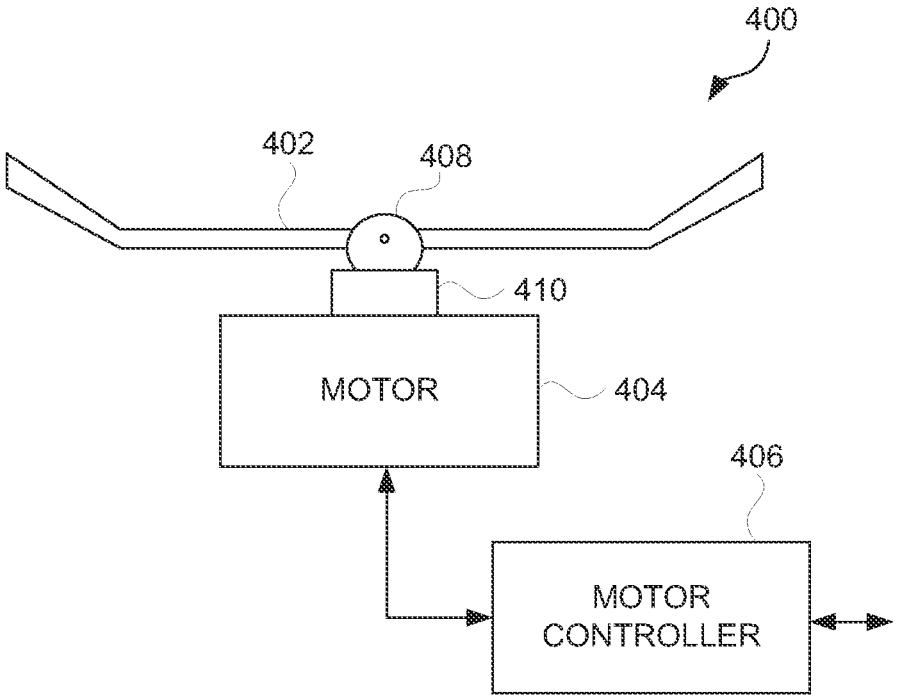
FIG. 4 is a block diagram of a flipping control system according to one embodiment.

FIG. 4 is a block diagram of a flipping control system 400 according to one embodiment. The flipping control system 400 operates to induce movement to a flipping structure 402 to cause dice residing on the flipping structure 402 to be flipped and thus randomized. The flipping control system 400 includes a motor 404 and a motor controller 406. The motor controller 406 generates one or more control signals that are provided to the motor 404 for controlling operation of the motor 404 which in turn causes movement to the flipping structure 402. The motor controller 406 includes a wired or wireless interface to communicate with another electronic apparatus. For example, the motor controller 406 can receive commands or data from a separate system or apparatus, such as a gaming system, a gaming apparatus, a user input device, a microprocessor, etc. Under the control of the motor controller 406, the motor 404 induces movement of the flipping structure 402. In one embodiment, the movement can be an abrupt movement to induce flipping action. In an alternative embodiment, the movement can be less abrupt such that a flipping action is not induced. In doing so, a pivot structure 408 for the flipping structure 402 can be mechanically manipulated by a drive transfer 410 mechanically coupled to the motor 404. The mechanical coupling used by the pivot structure 408 and/or the drive transfer 410 can include one or more gears and/or one or more belts and or any other suitable coupling technology.

Figure 5:
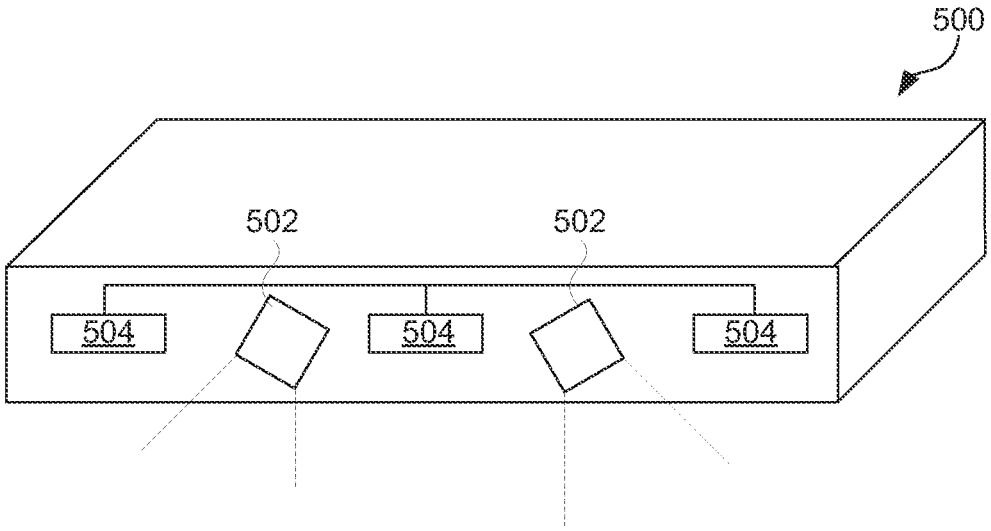
FIG. 5 is a schematic diagram of a top structure according to one embodiment.

FIG. 5 is a schematic diagram of a top structure 500 according to one embodiment. The top structure 500 is, for example, suitable for the top structure 204 illustrated in FIG. 2 or the top structure 304 illustrated in FIG. 3A. The top structure 500 can include one or more cameras 502 and/or one or more light sources 504. As illustrated in FIG. 5, in one embodiment, the top structure 500 can include two cameras 502, where a first of the cameras 502 can be directed to a first end portion (214, 314) and a second of the cameras 502 can be directed to a second end portion (216, 316). As also illustrated in FIG. 5, in one embodiment, the top structure 500 can include one or more (i.e., three) light sources 504. These light sources 504 can be distributed within the top structure 500. In one embodiment, the top structure 500 can also include one or more light diffusers that can be placed proximate to the light sources 504, such as placed between the light sources 504 and the associated container so that light from the light sources 504 can be diffused.

Figure 6A:
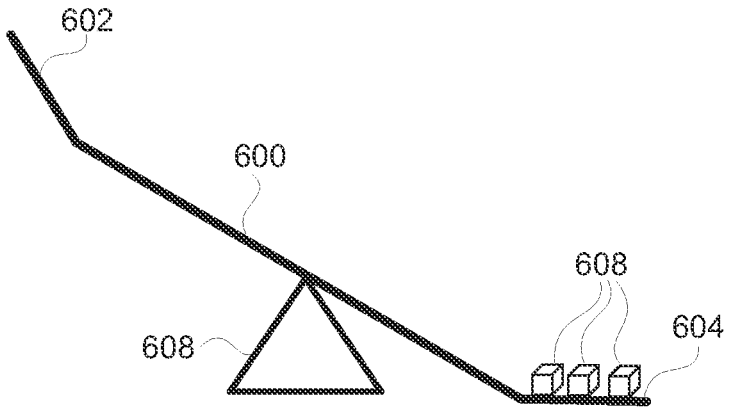
FIGS. 6A-6C are schematic diagrams of a flipping action in which gaming objects, such as dice, are able to be flipped and thus randomized, according to one embodiment.
Figure 6B:
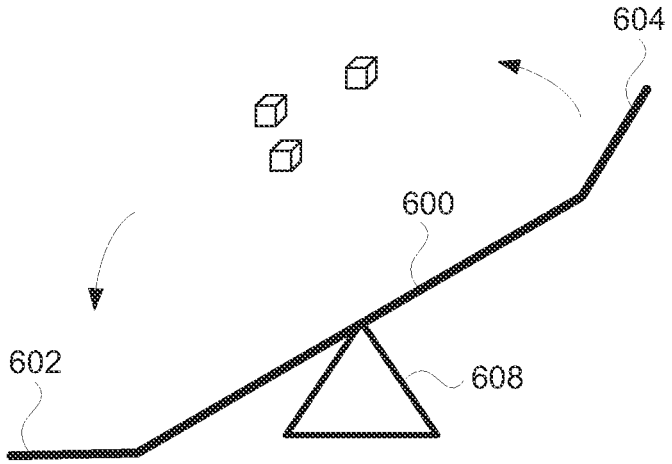
Figure 6C:
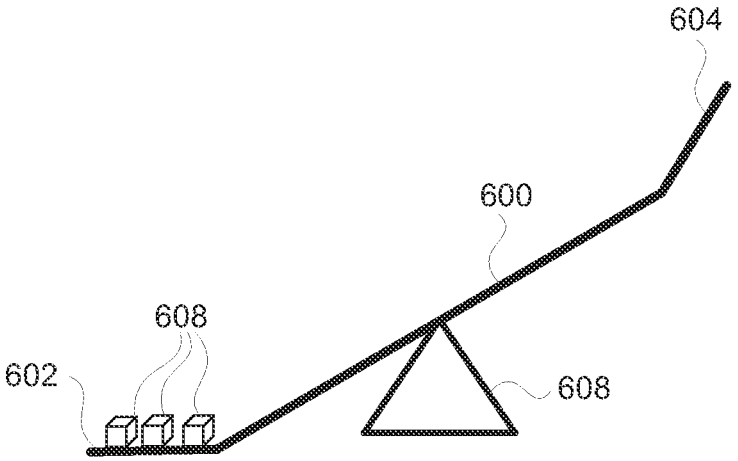

FIGS. 6A-6C are schematic diagrams of a flipping action in which gaming objects, such as dice, are able to be flipped and thus randomized, according to one embodiment.

FIG. 6A illustrates a flipping structure 600 having a first angled end 602 and a second angled end 604. In the position of the flipping structure 600 shown in FIG. 6A, the second angled end 604 is position downward such that the second angled end 604 is substantially horizontal, while the first angled end 602 is positioned upward with the first angled end 602 being significantly vertical. Dice 608 are shown as settled on the second angled end 604. This position of the flipping structure 600 and the dice 608 can be referred to as a rest position or a start position. For example, the angled end 602 and/or the second angled end 604 can be angled upward 5-30% relative to a central portion of the flipping structure 600.

FIG. 6B illustrates the flipping structure 600 after a flipping action has been induced. Specifically, as shown in FIG. 6B, the second angled end 604 is now significantly vertical while the first angled end 602 is substantially horizontal. The dice 608 have been rendered airborne by the rapid moving of the flipping structure 600 from its position shown in FIG. 6A to its position shown in FIG. 6B. Advantageously, the dice 608 are able to be forced airborne into a rather high arc of movement which provide increased airtime and thus more spinning and rotating of the dice on any given flip via the flipping structure 600.

FIG. 6C illustrates the flipping structure 600 after the flipping action has been induced and also after the dice 608 have settled at the first angled end 602. Once the dice 608 have settled following the flipping action, the value of the individual dies have been randomized by the flipping action. In one embodiment, the top surfaces of the first angled end 602 and the second angled end 604 can include a layer of felt (or other material) that allows the dice to settle more quickly and in a reliable final position. Additionally, if the associated dice flipping apparatus includes a camera, the camera can be used to acquire one or more images of the resultant die values (after they have settled) which can be used to electronically determine the value of the dies through image recognition. These die values can then be displayed or otherwise utilized by an associated apparatus, such as a gaming machine, gaming console, and the like.

Figure 7:
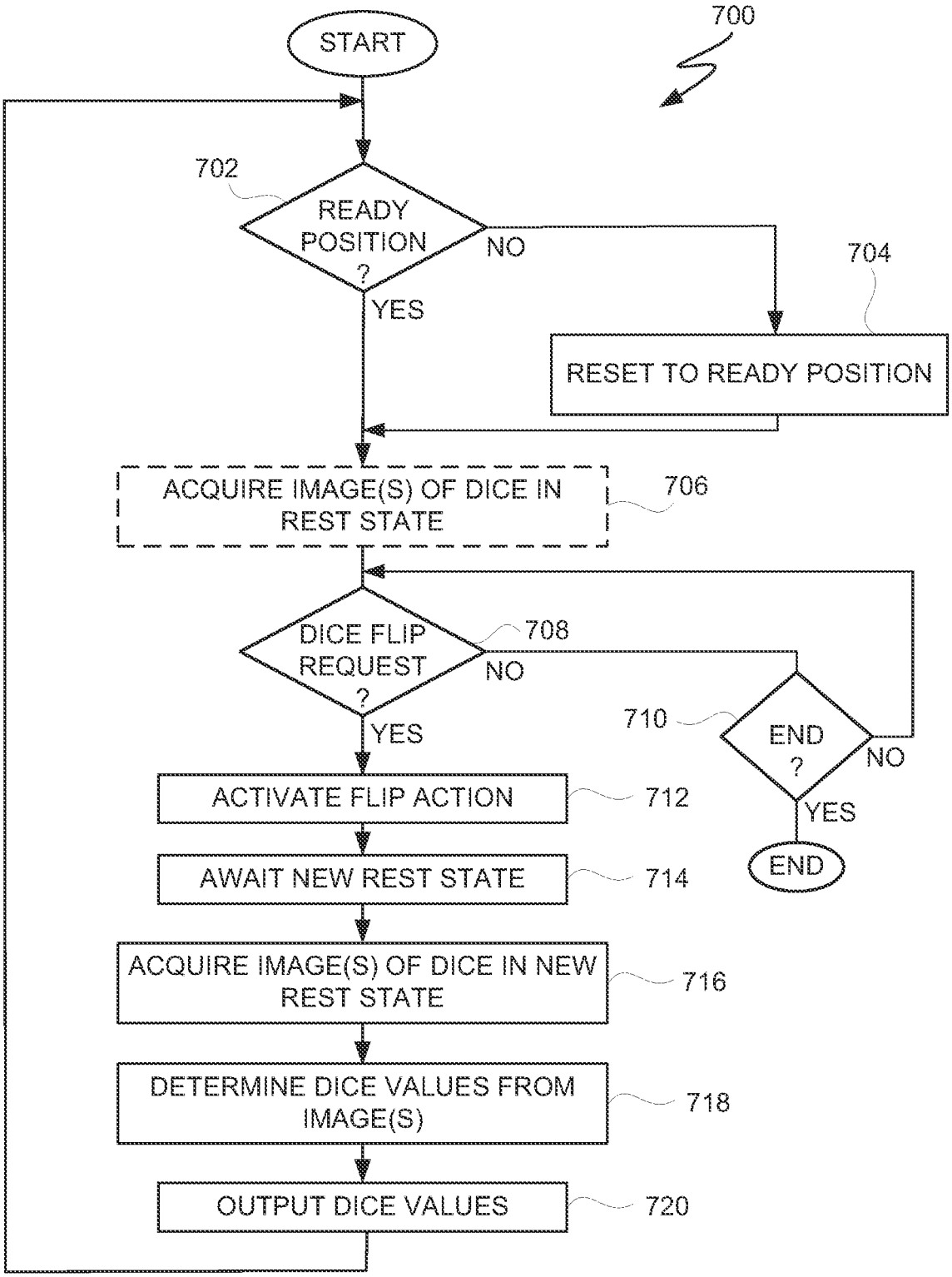
FIG. 7 is a flow diagram of a dice flipping process according to one embodiment.

FIG. 7 is a flow diagram of a dice flipping process 700 according to one embodiment. The dice flipping process 700 can, for example, be performed by a dice flipping apparatus, such as any of the dice flipping apparatus illustrated in FIGS. 1, 2 and 3A-3D.

The dice flipping process 700 can begin with a decision 702 that determines whether a dice flipping apparatus (or some component thereof) is in a ready position. The ready position is a position from which the dice are settled and ready to be flipped for randomization. When the decision 702 determines that a dice flipping apparatus is not presently in a ready position, the dice flipping process 700 can reset 704 the dice flipping apparatus to the ready position.

Alternatively, if the decision 702 determines that the dice flipping apparatus is in the ready position (or following the reset 704 to the ready position), the dice flipping process 700 can acquire 706 one or more images of the dice in a rest state. Here, the images being acquired 706 can be images of the dice prior to a flipping action and/or of the dice after settling in response to a prior flipping action. In one embodiment, the block 706 can be eliminated, since it is optional.

Next, a decision 708 can determine whether a dice flip request has been received. Here, the associated apparatus (e.g., gaming apparatus) can initiate a dice flip request to the dice flipping apparatus. Hence, when the decision 708 determines that no dice flip request has been received, a decision 710 can determine whether the dice flipping process 700 should end. When the decision 710 determines that the dice flipping process 700 should end, the dice flipping process 700 can end. On the other hand, when the decision 710 determines that the dice flipping process 700 should not end, then the dice flipping process 700 returns to repeat the decision 708 and subsequent blocks so that the dice flipping process 700 can continue to await a dice flip request.

Once the decision 708 determines that a dice flip request has been received, a flip action can be activated 712. The flip action can, for example, induce flipping of the dice. For example, as illustrated in FIG. 6A prior to a flip action the dice can be in a rest state at one end of a flipping structure, and then following the flip action, the dice as shown in FIG. 6B are rendered airborne towards another end of the flipping structure, and then subsequently the dice assume a rest state at the another end. Hence, following the activation 712 of the flip action, the dice flipping process 700 awaits 714 a new rest state. Thereafter, one or more images of dice in the new rest state can be acquired 716. Dice values from the images can then be determined 718. In one implementation, using image recognition from the dice values of the dice as settled in the new rest rate can be electronically determined. Thereafter, the dice values can be output 720. For example, the dice flipping apparatus might display the dice values, and/or the associated apparatus (gaming apparatus) might display the dice values. Following the output 720 of the dice values, the dice flipping process 700 can return to repeat the decision 702 and subsequent blocks so that additional dice flipping operations can be similarly performed.

FIGS. 8A-8G are illustrations of a gaming machine 800, such as a gaming console, having a gaming object flipper in accordance with one embodiment. The gaming object flipper can operate to flip physical gaming objects (e.g., dice) that are use at or by the gaming machine to provide a randomized input for a wager-based game.

Figure 8A:
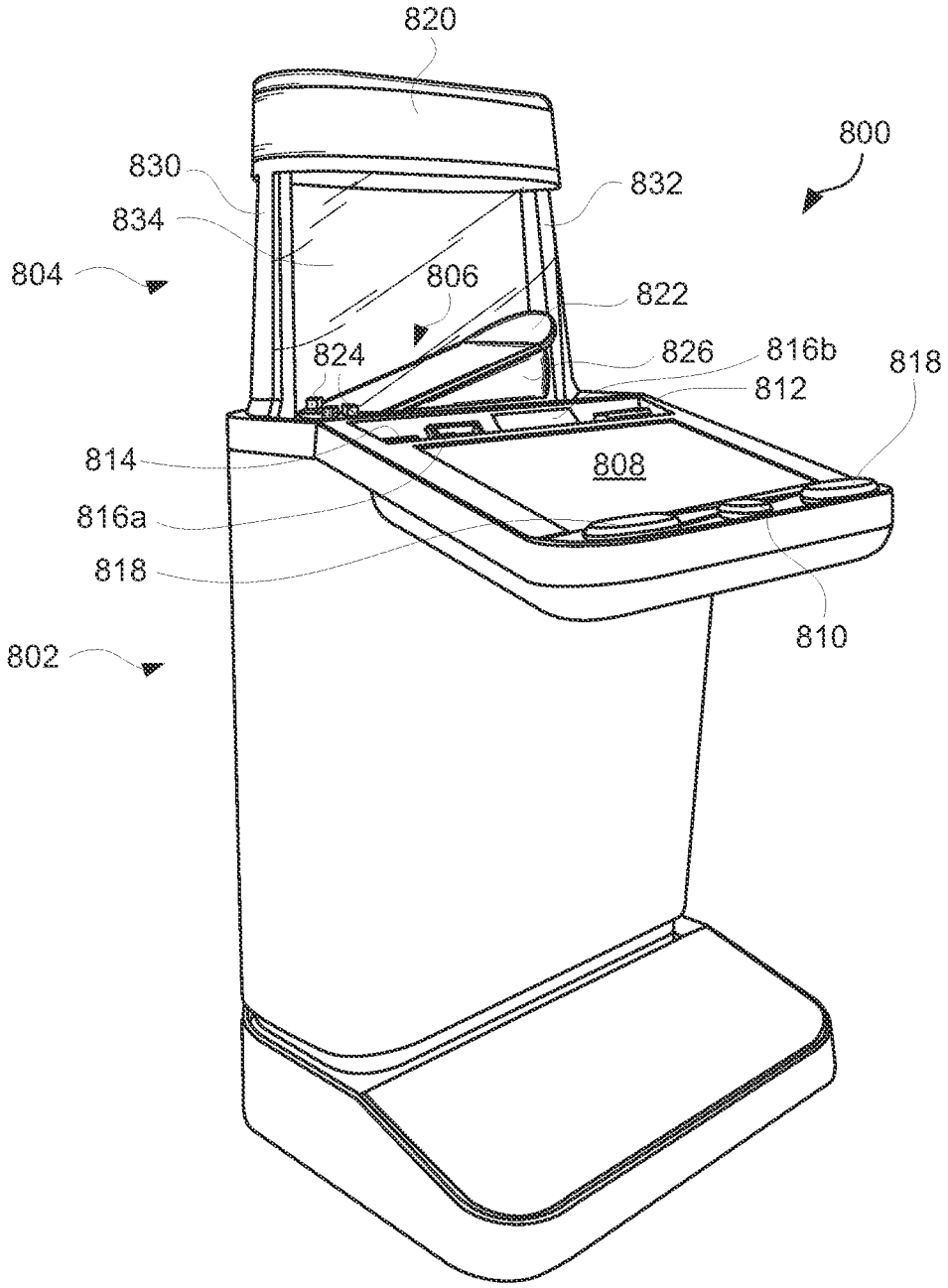
FIG. 8A is a side perspective view of a gaming machine having a gaming object flipper in accordance with one embodiment.

FIG. 8A is a side perspective view of the gaming machine 800 in accordance with the one embodiment.

Figure 8B:
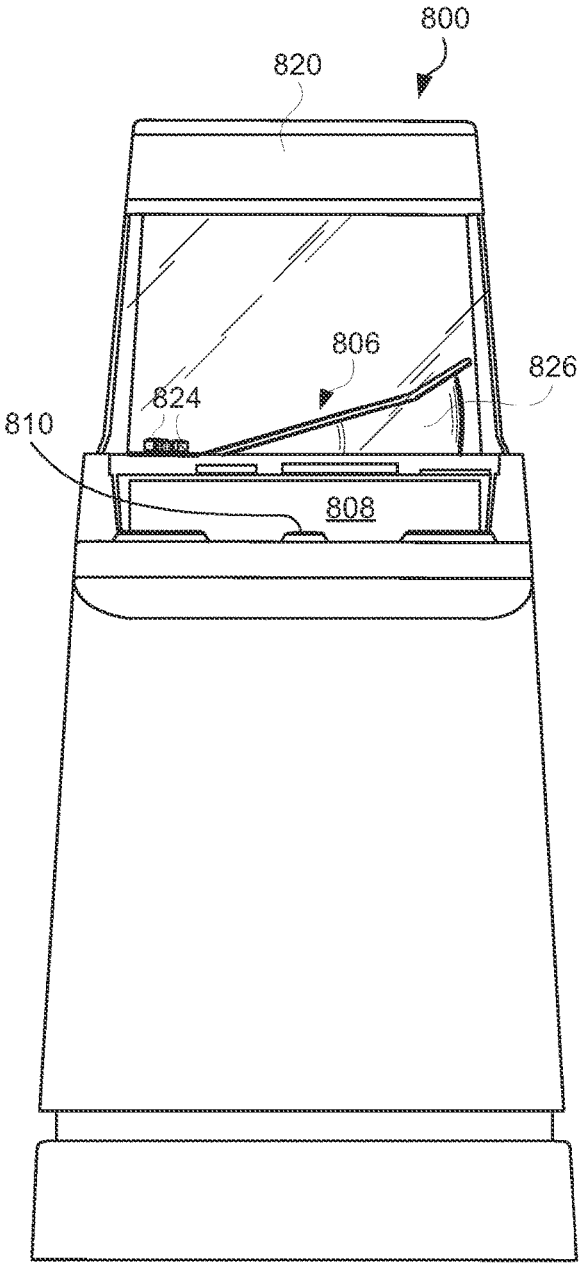
FIG. 8B is a front view for the gaming machine having the gaming object flipper in accordance with the embodiment.

FIG. 8B is a front view for the gaming machine 800 in accordance with the one embodiment.

Figure 8C:
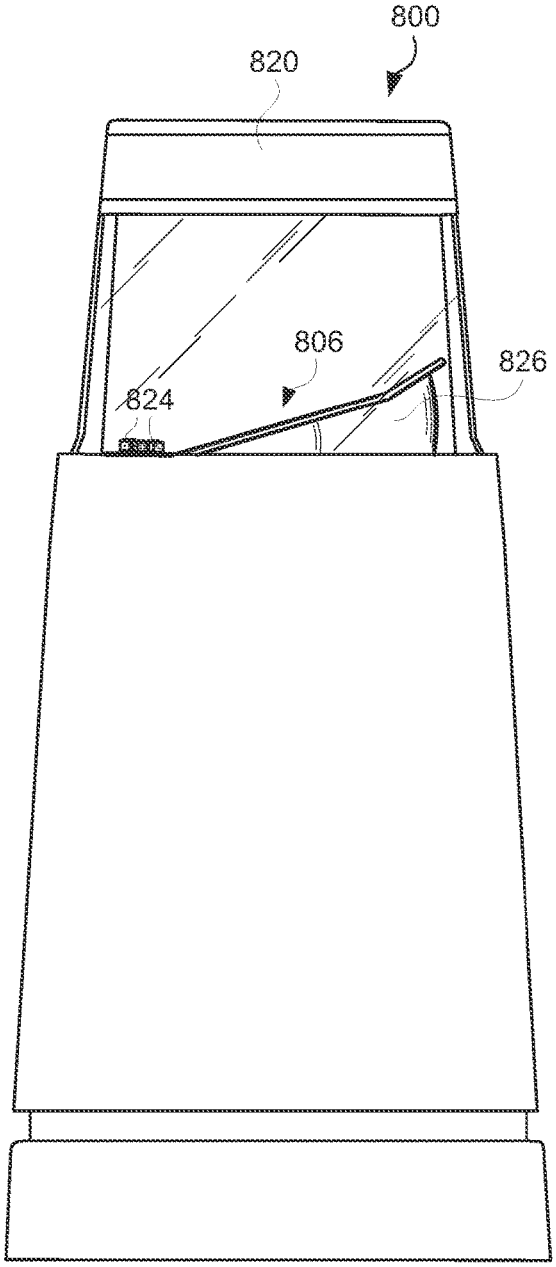
FIG. 8C is a rear view for the gaming machine having the gaming object flipper in accordance with the embodiment.

FIG. 8C is a rear view for the gaming machine 800 in accordance with the one embodiment.

Figure 8D:
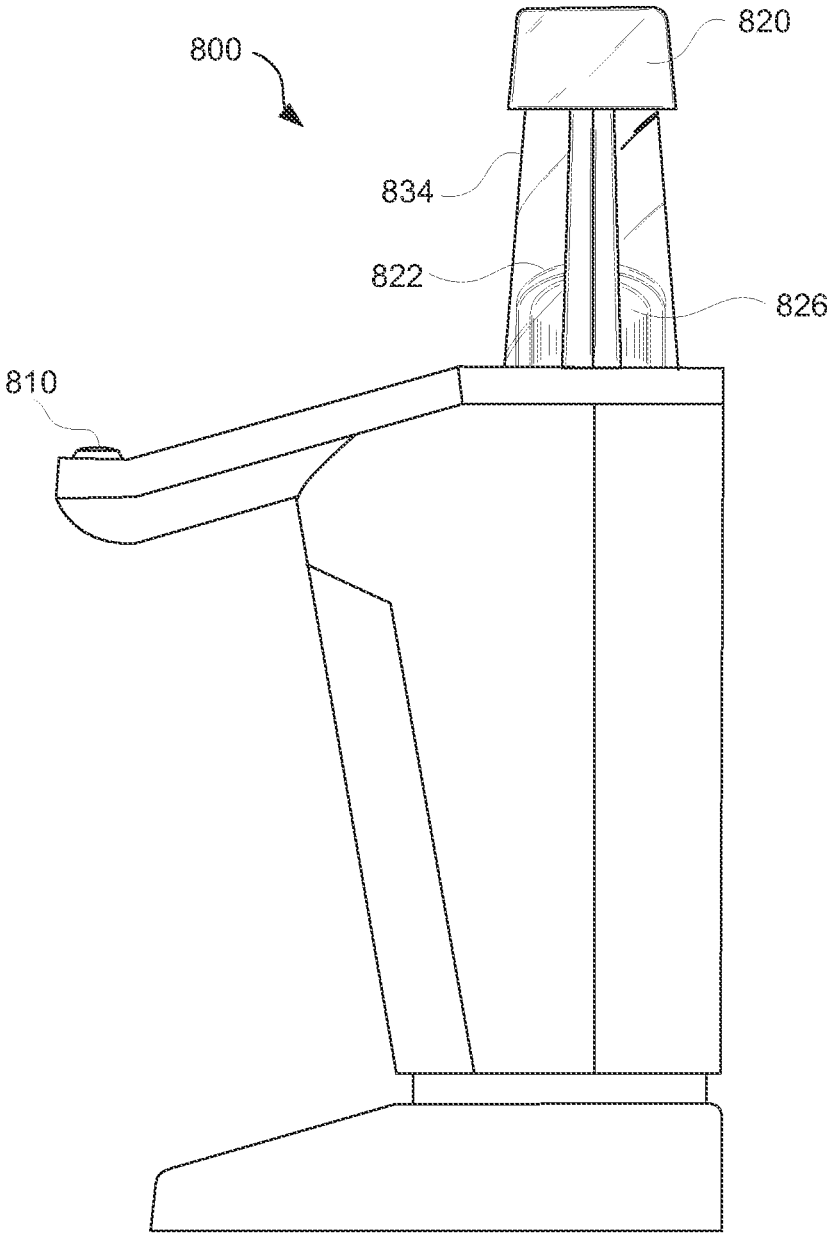
FIG. 8D is a right side view of the gaming machine having the gaming object flipper in accordance with the embodiment.

FIG. 8D is a right side view of the gaming machine 800 in accordance with the one embodiment.

Figure 8E:
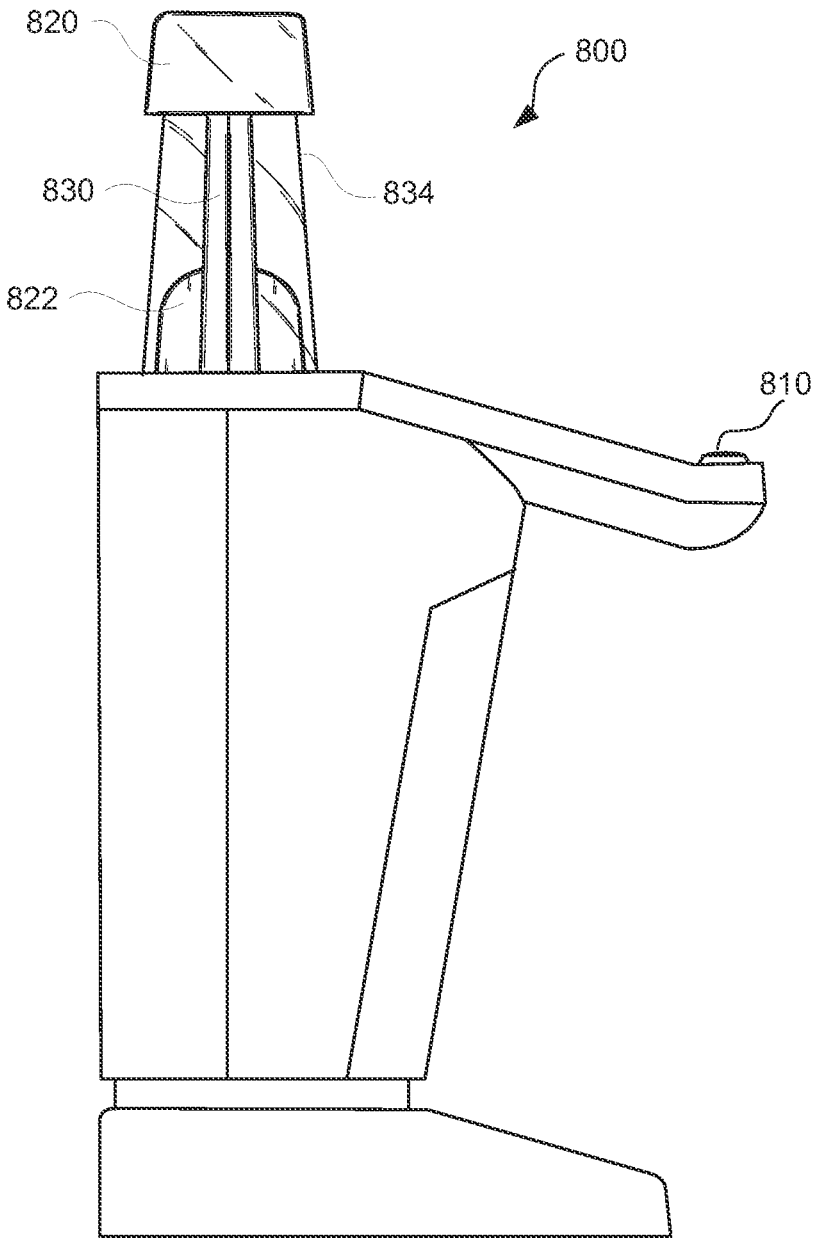
FIG. 8E is a left side view for the gaming machine having the gaming object flipper in accordance with the embodiment.

FIG. 8E is a left side view for the gaming machine 800 in accordance with the one embodiment.

Figure 8F:
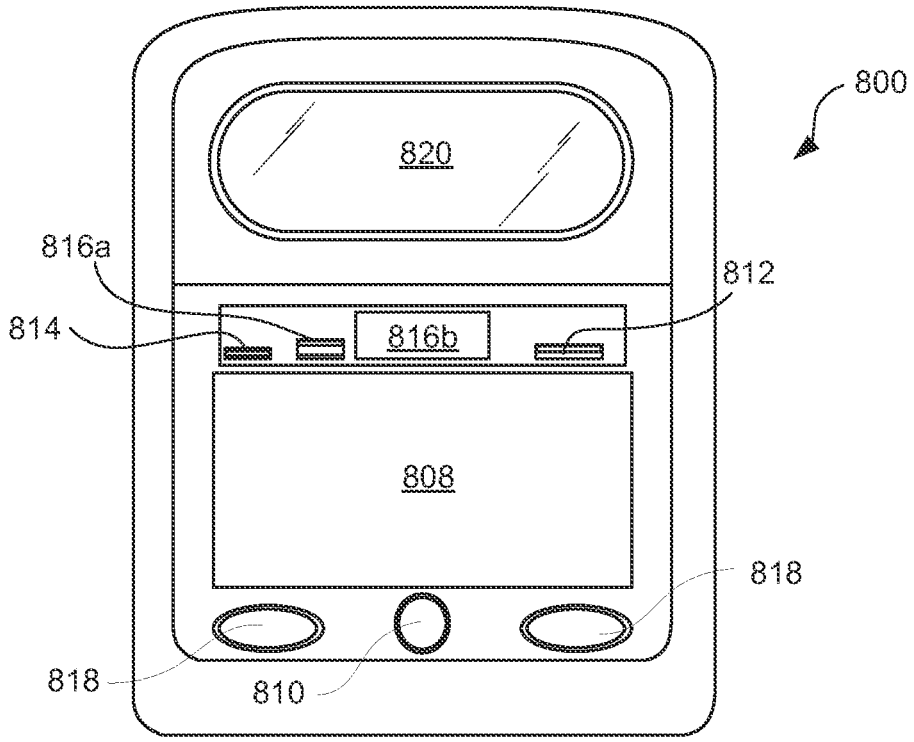
FIG. 8F is a top view for the gaming machine having the gaming object flipper in accordance with the embodiment.

FIG. 8F is a top view for the gaming machine 800 in accordance with the one embodiment.

Figure 8G:
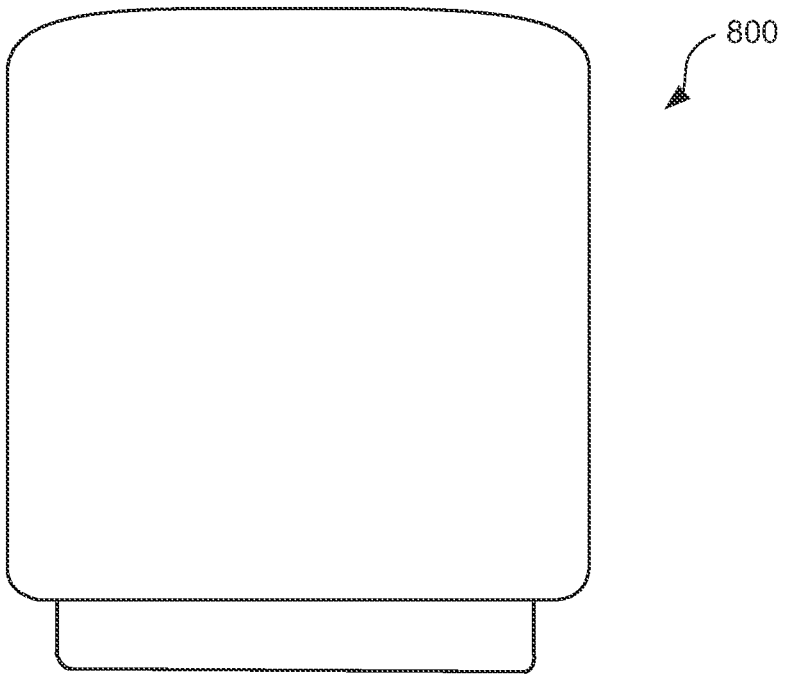
FIG. 8G is a bottom view for the gaming machine having the gaming object flipper in accordance with the embodiment.

FIG. 8G is a bottom view for the gaming machine 800 in accordance with the one embodiment.

In one embodiment, the gaming machine 800 shown in FIGS. 8A-8H is an electronic gaming machine 800. The electronic gaming machine 800 can also support wagering on one or more wager-based games, such as on the one or more table type games.

The electronic gaming machine 800 can include a base portion 802 and a top portion 804. The top portion 804 can include an object flipping apparatus 806. The object flipping apparatus 806 is a randomizing component. The object flipping apparatus 806 can flip physical objects (e.g., gaming objects) that are used with the one or more table type games. The physical object can pertain to one or more of dice, cards, balls, coins, and the like, which can be used individually, as group or in combination.

The base portion 802 can include a visual display 808, which can include a touch screen and/or other player input and output devices. One or more player (or user) inputs, such as button 810, can be used for a variety of player input functions, such as to facilitate activation of the object flipping apparatus 806. Alternatively, the player inputs can be provided using other devices, e.g., joystick, mouse, track ball, touch pad, and the like.

The base portion 802 can also include an acceptor 812, a printer 814 and a player tracking sub-system 816. The acceptor 812 can accept bills, tickets or vouchers and provide player credit for game play at the electronic gaming machine 800. The printer 814 can print tickets or vouchers. The player tracking sub-system 816 can include a player card reader 816*a* and an associated screen 816*b*. Further still, the base portion 802 can also include wrist pads 818 to facilitate user comfort. Other items not shown may also be included, with such items including, for example, cameras, additional displays, lights, additional inputs (e.g., trackball, mouse), speakers, seats, and the like.

The object flipping apparatus 806 provides randomness to one or more game objects that are used with wager-based games being performed by the electronic gaming machine 800. The game objects can represent any game objects or objects as might be found on a live gaming table, including for example, dice, cards, balls, and the like, which may be presented alone or in any combination. The object flipping apparatus 806 can include means to randomize results associated with the game objects, such as thought a flipping action. The game objects can be used to provide a substantially random outcome that yields game input(s) to the wager-based game, which can then yield a game result for a player of the electronic gaming machine 800.

In one embodiment, the object flipping apparatus 806 can include a flipping platform 822 that can service to flip gaming objects, namely dice 824, to thereby randomize their die values. For example, if the game objects consist of three dice 824, then each die after being flipped can yield a die value for use with a wager-based game. Although the dice 824 can serve as the game objects, it will be readily appreciated that other game objects could be used as well.

Variations in the randomizing action of the game objects can be impacted by programming and/or by one or more player inputs provided via the electronic gaming machine 800. For example, variations in characteristics (e.g., rate, force, speed or duration) of the flipping action can be impacted by player inputs via the button 810, touch screen, or any other player input device. The manner in which the player interacts with the button 810 can also impact the characteristics of the flipping action. For example, a hard push or pounding of button 810 might result in a stronger flipping action, while a soft push of the button 810 might result in a gentle flipping action. Also, or in addition, the timing of the press of the button 810 might affect the timing of one or more physical activations that provide a new game object outcome. Such timings may affect when the physical actuation starts, when it stops, and/or its duration, for example. Such timings might also coincide with other visual or audio outcomes or cues provided by the electronic gaming machine 800, such as on the visual display 808 or elsewhere.

Other types of player input components could also be used, with similar and/or additional effects to the physical game components. Such other player activation components could include, for example, plungers, touch screens adapted to accept various touches, swipes or the like, motion or gesture reading sensors, voice recognition devices, and the like. For example, a motion sensor might be adapted to help the device or system recognize a hard flip player activation based upon a rapid or fast motion or gesture by a player, and/or to recognize a soft flip player activation based upon a gentle or slow motion or gesture by the player. Alternatively, and/or in addition, a microphone and voice recognition device might be adapted to help the device or system recognize various voice commands, as well as volume levels.

The top portion 804 can include a top member 820, which may or may not be game or theme related. The top portion 804 can also include one or more cameras that are configured to capture images of the dice 824. One the dice 824 have settled after a flipping action, the resulting values of the dies can be computer recognized and thus determined from the captured images of the dice 824. The flipping action of the flipping platform 822 causes one side to flip upward, while the opposing side flips down. The object flipping apparatus 806 can also include a camouflage skirt 826 provide below the flipping platform 822 to provide an aesthetic effect, namely, covering any mechanical members under the flipping platform.

The top portion 804 also forms a compartment 828. The compartment 828 securely contains the object flipping apparatus 806 and the dice 824. In this regard, the flipping platform 822 and the container 828 are configured to have their respective sides or edges in close proximity so that the dice 824 remain in the container 828 and above the flipping platform 822 (even during flipping). As such, the dice 824 are not able to pass between the edges of the flipping platform 822 and the sides of the container 828. The compartment 828 has rigid side ends 830, 832. The compartment 828 also has a transparent (or slightly translucent) front side 834. The compartment 828 can also have a transparent (or slightly translucent) back side. Advantageously, during a flipping action, a user of the electronic gaming machine 800 can see the dice 824 undergoing flipping through the front side 834. One or more additional items may also be included in or on top portion 804, such as a top glass, bezel, speaker, light, additional displays, input or output components, or the like. Also, various items that might be located in the top member 804 may instead be included on the bottom portion 802, and vice versa.

In various embodiments, the base portion 802 can be removable from and interchangeable with top portion 804 and other similar top portions, and vice versa. Similarly, top portion 804 can be removable from and interchangeable with bottom portion 802 and other similar bottom portions. Under any such arrangement, the object flipping apparatus 806 may also comprise a separate item that goes with or is removable from and/or interchangeable with the bottom portion 802, the top portion 804, or both. In some embodiments, the object flipping apparatus 806 and/or the top portion 804 can be modular from the remainder of the electronic gaming machine 800, such that different physical randomizing components can be swapped in and out of the electronic gaming machine 800 as may be desired.

In various embodiments, one or more cameras, sensors, or other detection devices can be used to detect the actual outcomes on the one or more game objects (e.g., dice 824). Sensors could include, for example, cameras, RFID readers, magnetic readers or detectors, barcode readers or the like, pressure sensors, motion detectors, among other possible sensors. Such a camera(s) and/or other sensor(s) can be located about the top portion 804, at or within the object flipping apparatus 806, and/or at other locations at or along the electronic gaming machine 800 (e.g., bottom portion 802), as may be appropriate. In some embodiments, these cameras and/or other sensors can remain with the base portion 802 while a given randomizing component is interchanged or swapped out for another one. Replaceable sensor components and/or other randomizing component items can add to the varieties of user selection and preferences for the electronic gaming machine 800.

Figure 8H:
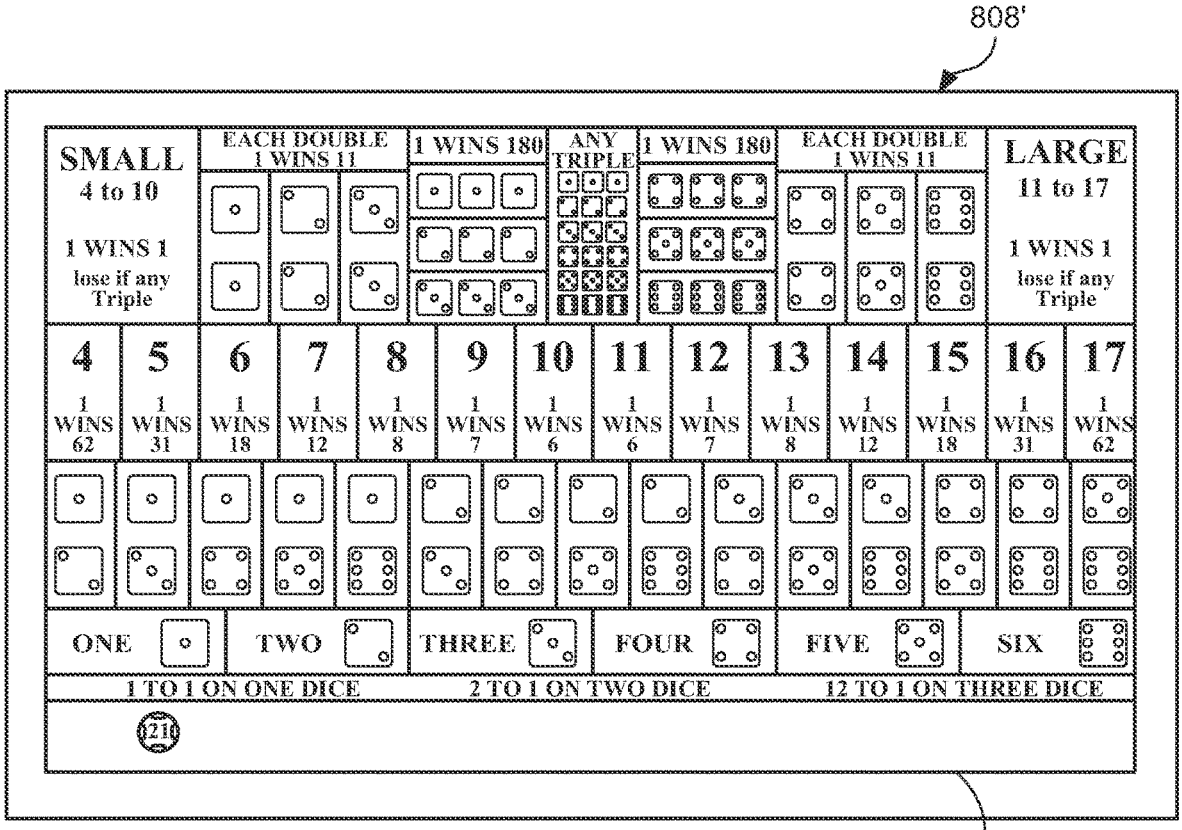
FIG. 8H illustrates the visual display of the electronic gaming machine implementing an exemplary touch screen display.

FIG. 8H illustrates the visual display 808' of the electronic gaming machine 800 implementing an exemplary touch screen display 850. The exemplary touch screen display 850 can present a plurality of selectable betting opportunities, which can be referred to as a bet board. The touch screen display 850 is capable of receiving a user touch section of one or more of the selectable betting opportunities being displayed.

Figure 8I:
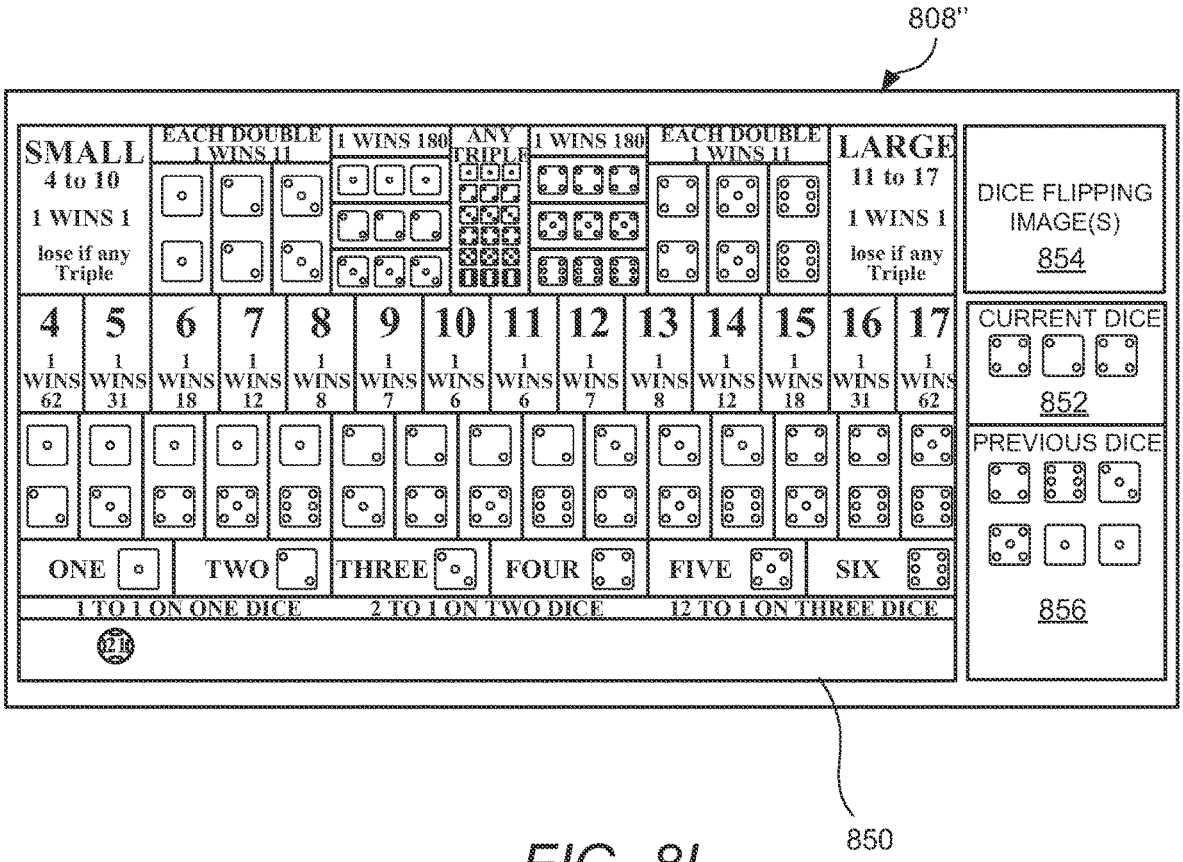
FIG. 8I illustrates the visual display of the electronic gaming machine implementing the exemplary touch screen display, such as shown in FIG. 8H.

FIG. 8I illustrates the visual display 808" of the electronic gaming machine 800 implementing the exemplary touch screen display 850, such as in FIG. 8H. In this implementation, the visual display 808" can further include a current dice region 852, a dice flipping image(s) region 854 and a previous dice region 856. The current dice region 852 can display the most recent dice values that result from dice randomization, namely, a dice flipping action. The dice flipping image(s) region 854 can display one or more visual images (still or video) of such dice being "flipped" or otherwise being randomized. This can occur in real-time. Alternatively or additionally, the dice flipping image(s) region 854 can display one or more visual images of such dice after they have settled following being "flipped" or otherwise being randomized. The previous dice region 856 can display an integer number of most recent dice values that result from prior dice randomizations. The previous dice region 856 thus provides historical resulting dice values.

It will be readily appreciated that the electronic gaming machine 800 can be provided in numerous other configurations and formats, such that the provided example is for illustrative purposes only. In various embodiments, an electronic gaming machine can be designed or configured similar to a standard "slot machine," such that only one actual player sits at or otherwise occupies the machine, and is the only player that is permitted to make wagers and plays on the game outcomes at the device. Of course, other people may watch or comment as the one player plays at the electronic gaming machine designed for individualized play. In some embodiments, other players might be allowed to make wagers on the game outcomes, such as where remote monitoring and play is permitted across a system of electronic gaming machines.

In one embodiment, an electronic gaming machine can have a dedicated gaming object flipping apparatus. The electronic gaming machine 800 illustrated in FIG. 8A is one example of such an embodiment.

Figure 9:
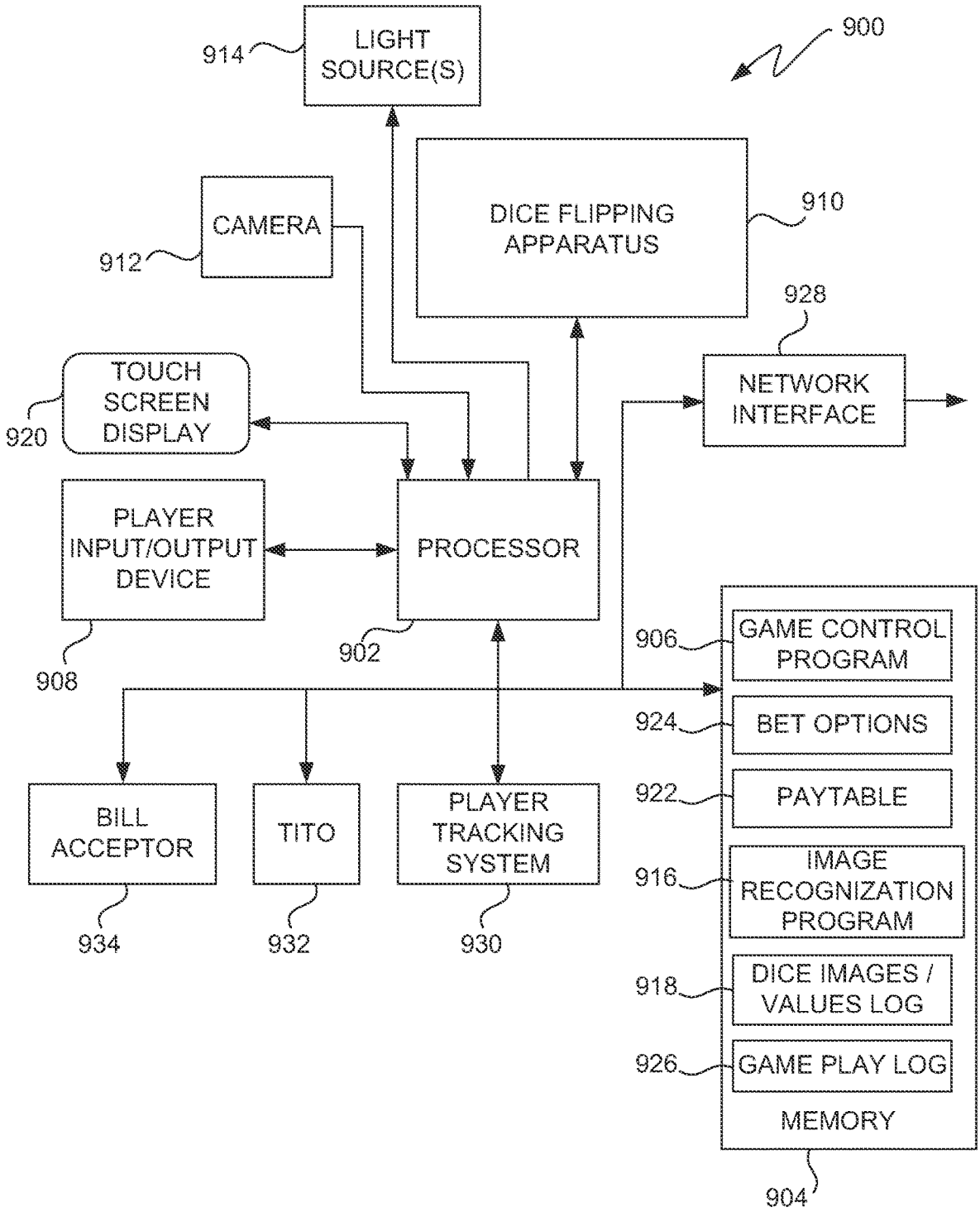
FIG. 9 is a block diagram of an electronic gaming machine according to one embodiment.

Still further, it should be appreciated that an electronic gaming apparatus or system can utilized a shared gaming object flipping apparatus. Typically, the electronic gaming apparatus or system is provided in various multi-player configurations. In one embodiment, a gaming object flipping apparatus can be shared by a plurality of electronic gaming machines (e.g., slot machines, gaming terminals, electronic gaming tables, etc.). In one implementation, the plurality of electronic gaming machines can be provided in a carousel arrangement. In such an arrangement, the shared gaming object flipping apparatus can be provided in a center region of the carousel arrangement of the plurality of electronic gaming machines, For example, four to twelve electronic gaming machines arranged in a carousel arrangement might not themselves include an gaming object flipping apparatus but instead a shared gaming object flipping apparatus (which can be referred to as a community gaming object flipping apparatus) can be provided and shared by the various gaming machines. In another implementation, the plurality of electronic gaming machines can be provided in a stadium arrangement. In such an arrangement, the shared gaming object flipping apparatus can be provided at a front stage area and be used by all the plurality of electronic gaming machines provided in the stadium arrangement, FIG. 9 is a block diagram of an electronic gaming machine 900 according to one embodiment. The electronic gaming machine 900 can, for example, pertain to the electronic gaming machine 800 illustrated in FIG. 8. The electronic gaming machine 900 can include a processor 902 that controls operation of the electronic gaming machine 900. The processor 902 can be coupled to a memory 904 that stores a game control program 906. The game control program 906 when executed by the processor 902 provides a wager-based game on the electronic gaming machine 900. The wager-based game can pertain to a primary game and/or a bonus game. The electronic gaming machine 900 can also receive user input and/or provide user output via a player input/output device 908. The player input/output device 908 can pertain to one or more of a button, display, touch screen, and the like.

The electronic gaming machine 900 also includes a dice flipping apparatus 910 that operates to flip dice and provide a randomized input for the wager-based game. The dice flipping apparatus 910 provide a mechanism to flip dice to provide a randomized input to the wager-based game. The dice flipping apparatus 910 can, for example, be implemented as shown in any of the embodiments discussed above.

The electronic gaming machine 900 can include at least one camera 912 and one or more light sources 914. The at least one camera 912 can capture images of the dice in the dice flipping apparatus 910. The one or more light sources can illuminate the dice flipping apparatus 910 and/or other portions of the electronic gaming apparatus.

The memory 904 can also store an image recognition program 914 and a dice images/values log 918. The image recognition program 916 pertains to program code that, when executed by the processor 902, can digitally evaluate the images (e.g., from the at least one camera 912) of the dice in the dice flipping apparatus 910 to determine values (e.g., 1, 2, 3, 4, 5 or 6) of each of the dies as settled following the flipping. The dice images/values log 918 can store in the memory 904 images of the dies and/or the determined values for the dies.

The electronic gaming machine 900 can further include a touch screen display 920 that provide the player with an touch input surface as well as a display screen from a graphical user interface.

The memory 904 can also store a pay table 922 and bet options 924. The pay table 922 can be used internally and/or presented to a player, such as on a display or touch screen (e.g., the touch screen display 920). In one implementation, the pay table 922 can be provided to the player when the player engages the input/output device 908 or the touch screen display 920. The bet options 924 can store an indication of the one or more wagers or bets the player has invoked for the wager-based game, such as for example based on input received by the touch screen display 920, the player input/output device 908 and/or a peripheral device.

Still further, the memory 904 can also store a game play log 926 of all game information pertaining to the play of the wager-based game. The game play log 926 as well as the dice images/values log 918 can be advantageous for accounting reconciliation, regulation audits, and any other desired gaming functions.

The electronic gaming machine 900 also includes a network interface 928 to couple to one or more wired or wireless networks. The electronic gaming machine 900 can, for example, communicate with a server computer, such as a gaming management server of a gaming establishment. In one embodiment, the server computer can interact with the electronic gaming machine 900 to provide the wager-based game. In another embodiment, the electronic gaming machine 900 can assist the server computer (or vice versa) in providing the wager-based game or with any other gaming functions.

In addition, the electronic gaming machine 900 can also include one or more peripheral devices. As shown in FIG. 9, the electronic gaming machine 900 can include a player tracking system 930 (which can include a card reader and a small display), a Ticket-In-Ticket-Out (TITO) system 932, and a bill acceptor 934. Although illustrated with a few peripheral devices, this is not intended to be limiting as the electronic gaming machine 900 may have any number of peripheral devices.

Figure 10:
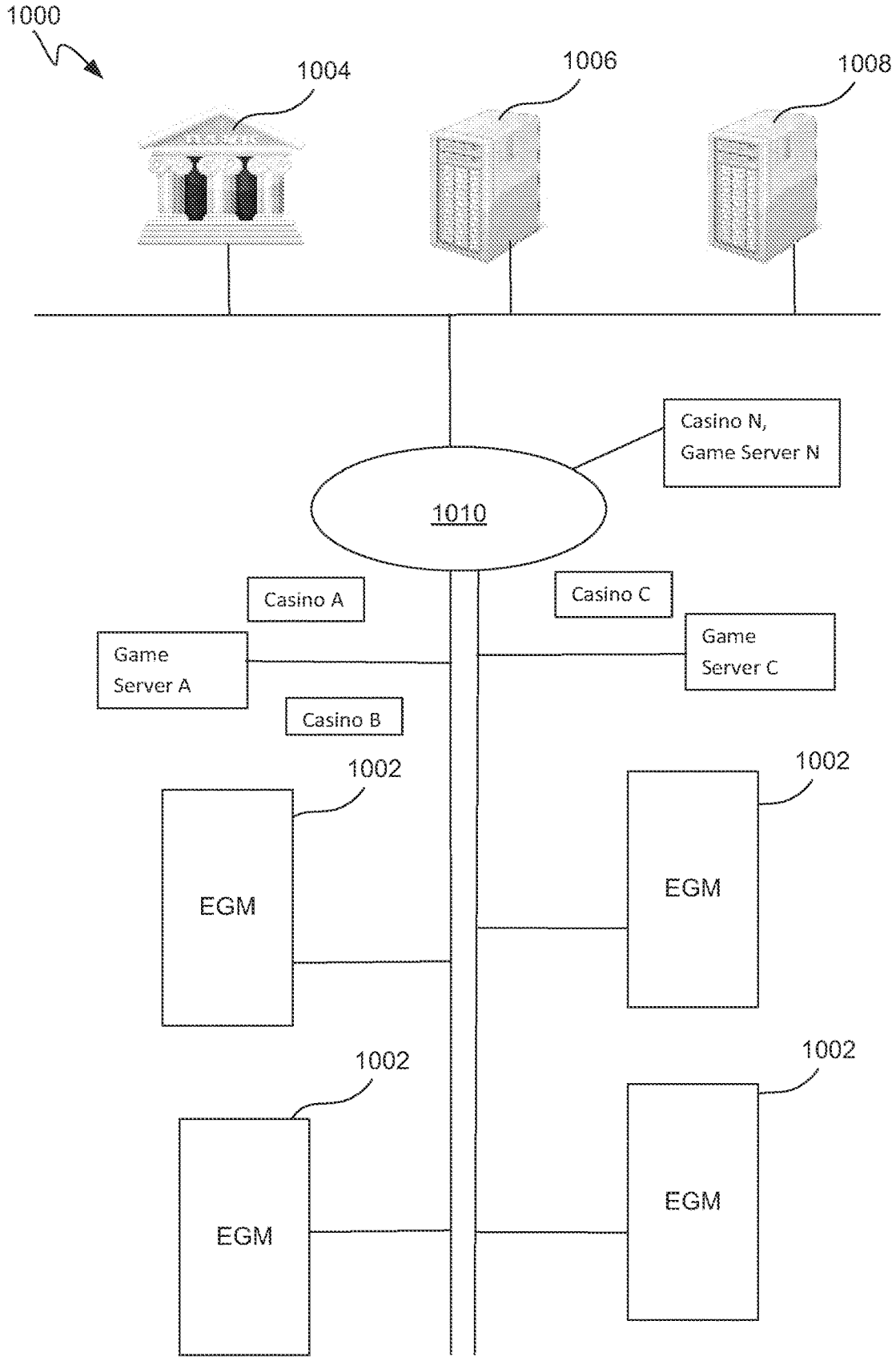
FIG. 10 is an exemplary block diagram of a wide area interactive table gaming machine system according to one embodiment.

FIG. 10 is an exemplary block diagram of a wide area interactive gaming machine system 1000 according to one embodiment. In this implementation, the gaming machine system 1000 is a table gaming machine system. The gaming machine system 1000 can utilize multiple electronic gaming machines (EGMs) 1002, one or more remote system servers, and various other system components across one or multiple locations. The gaming machine system 1000 can include a wide variety of components and items, such as a bank 1004, a games router 1006, and a financial clearinghouse 1008, among other items. A network 1010 can couple these items to the EGMs 1002, terminals, game servers, casinos, and other distributed components, as may be desired. Various networked casinos, game servers, EGMs 1002 and other remote terminals can also be coupled through the network 1010 in the gaming machine system 1000. The network 1010 can be of wired (Ethernet, Token Ring, Serial multi-drop, ATM, etc.) or wireless variety (802.11x, BlueTooth, LTE, 2G/3G/4G cellular, Zigbee, Ultra Wide Band, etc.) known in the art, as may be suitable or desired.

One or more game servers may be present in the gaming machine system 1000, and each may operate in a particular manner to facilitate the play of the various networked EGMs 1002 set forth above. In such embodiments, a game server can collect live game information from each of the self-contained EGM 1002, apply game rules, determine game results, determine winning amounts, and any other gaming operation information and/or data. Besides monitoring and controlling the games, the game server can also keep track, such as in a database, the game history of each of the EGMs 1002 and its associated physical components, accounting information, revenue reports, bonuses and bonusing progress, mystery jackpots, maintenance information, and the like. Each of these individual functions can be performed by a separate application on a separate server, or integrated into one application running on one comprehensive server. The determination of one or multiple servers and applications depends on the number of EGMs, game stations, casinos, and other associated devices, both local and remote, that are being connected across the gaming machine system 1000. For example, a specialized system server or processor can be dedicated to tracking playing card IDs and locations.

Additional functions of the servers in the gaming machine system 1000 can include game resolution at various EGMs 1002, the handling of financial transactions from EGMs 1002 and/or remote game terminals, the push of live game information to a game server to be broadcast to other EGMs 1002 and other remote gaming terminals, matchmaking between various system devices and stations, providing communications between system components, and other pertinent gaming system functions.

Additional details regarding these and other gaming system functions can be found at, for example, U.S. Pat. Nos. 8,808,077; 8,684,830; and 8,821,239 each of which are incorporated by reference herein for such purposes, and also U.S. patent application Ser. Nos. 13/893,340; 13/844,617; and Ser. No. 14/508,922, each of which are incorporated by reference herein for such purposes.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiver terminals, and may be a standalone device or incorporated in another platform, such as an existing electronic gaming machine, portable computing device or electronic platforms with multiple player positions. Those skilled in the art will further appreciate that the precise types of software and hardware used are not vital to the full implementation of the methods of the disclosure so long as players and operators thereof are provided with useful access thereto or the opportunity to play the game as described herein.

Further, the object flipping structure/platform described herein, including the flipping structure 104, 212, 312, 402, 600 or the flipping platform 822, can be formed or constructed in various way from various materials. In one implementation, the object flipping structure/platform can be rigid, such as metal or hard plastic, and can also include a soft top surface such as felt. In another implementation, the object flipping structure/platform can include a rigid layer, such as a metal or hard plastic layer, a compliant layer, such as rubber, elastomeric or other flexible material, and also a soft top layer such as felt. In another implementation, the object flipping structure/platform can include a compliant layer, such as rubber, elastomeric or other flexible material, and may but need not have a rigid or soft layer, but could have a structural support, such as an underlying frame. More generally, the flipping structure/platform can have a laminate construction. In yet another implementation, the ends of the flipping structure/platform (or at least a layer thereof) can be thinner that the center portion for added flexibility at the ends.

The various aspects, features, embodiments or implementations of the invention described above can be used alone or in various combinations.

Embodiments of the invention can, for example, be implemented by software, hardware, or a combination of hardware and software. Embodiments of the invention can also be embodied as computer readable code on a computer readable medium. In one embodiment, the computer readable medium is non-transitory. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A gaming object randomization apparatus, comprising:

a container configured to contain one or more gaming objects, the container having a top portion, a bottom portion and a plurality of sides, at least a substantial portion of at least one of the sides being transparent, the container containing a randomization structure; and an actuator mechanically coupled to the randomization structure;

wherein the randomization structure includes a unitary platform, the platform having a first end portion, a central portion and a second end portion, the first end portion being fixed at an upward angle relative to the central portion, and the second end portion being fixed at an upward angle relative to the central portion, wherein the one or more gaming objects settle at only either of the first end portion or the second end portion of the platform, the first end and the second end portions being at opposing sides of the platform, and wherein the actuator is configured to induce a randomization action to move the platform of the randomization structure to cause the one or more gaming objects to rotate in the container in a first direction from the first end portion to settle at the second end portion, or alternatively in a second direction from the second end portion to settle at the first end portion.

2. A gaming object randomization apparatus as recited in claim 1, wherein a camera, internal or external to the gaming object randomization apparatus is configured to acquire at least one image of the one or more gaming object at the first or second end portion after settling following the randomization action.

3. A gaming object randomization apparatus as recited in claim 2, wherein the second direction is opposite to the first direction.

4. A gaming object randomization apparatus as recited in claim 2, wherein the opposing sides of the platform are adjacent the respective sides of the container.

5. A gaming object randomization apparatus as recited in claim 1, wherein the gaming object randomization apparatus comprises a camouflage material provide at an underside of the platform.

6. A gaming object randomization apparatus as recited in claim 1, wherein the first end portion being angled upward 5-30% relative to the central portion, and the second end portion being angled upward 5-30% relative to the central portion.

7. A gaming object randomization apparatus as recited in claim 1, wherein the container has an oblong configuration.

8. A gaming device, comprising:

a game console providing a user interface for game play, the user interface including a display region that displays one or more gaming object values; and a gaming object randomization apparatus coupled to the game console, the gaming object randomization apparatus including at least:

a container configured to contain one or more gaming objects, the container having a top portion, a bottom portion and a plurality of sides, the container containing a randomization structure; and an actuator mechanically coupled to the randomization structure, wherein the randomization structure includes a unitary platform, the platform having a first end portion, a central portion and a second end portion, the first end portion being permanently angled upward relative to the central portion, and the second end portion being permanently angled upward relative to the central portion, wherein the one or more gaming object settle at either of the first end portion or the second end portion of the platform, the first end portion and the second end portion being at opposing sides of the platform, and wherein the actuator is configured to induce a randomization action to move the platform of the randomization structure to cause the one or more gaming objects to rotate in the container in a first direction from the first end portion to settle at the second end portion, or alternatively in a second direction from the second end portion to settle at the first end portion.

9. A gaming device as recited in claim 8, wherein the first end portion has a first raised edge, and wherein the second end portion has a second raised edge, and wherein the second direction is opposite to the first direction.

10. A gaming device as recited in claim 9, wherein the first raised edge extends upward and is provided adjacent a corresponding one of the sides of the container, and wherein the second raised edge extends upward and is provided adjacent another corresponding one of the sides of the container.

11. A gaming device as recited in claim 8, wherein the gaming device comprises:

a touch screen configured to display a plurality of selectable betting opportunities and capable of receiving a user touch section of one or more of the selectable betting opportunities being displayed.

12. A gaming device as recited in claim 11, wherein the touch screen provides at least a part of the user interface.

13. A gaming device as recited in claim 8, wherein the one or more gaming object values displayed at the display region of the game console are determined based on at least one image acquired via a camera.

14. A gaming device as recited in claim 13, wherein the gaming device comprises:

a touch screen configured to display a plurality of selectable betting opportunities and capable of receiving a user touch section of one or more of the selectable betting opportunities being displayed, the touch screen providing at least a part of the user interface.

15. A gaming device as recited in claim 14, wherein the gaming object randomization apparatus further comprises:

a motor coupled to the actuator and configured to cause the actuator to move the randomization structure.

16. A gaming device as recited in claim 15, wherein the gaming object randomization apparatus further comprises:

a motor controller operatively connected to the motor, the motor controller being configured to control operation of the motor and thus control movement of the actuator.

17. A gaming device as recited in claim 16, wherein the controlled movement of the actuator by the motor and motor controller induces the randomization action.

18. A method of randomizing to one or more gaming objects, comprising:

receiving a gaming object randomize request;

inducing a randomization action to the one or more gaming objects based at least in part on the gaming object randomize request;

permitting the one or more gaming objects to settle following the randomization action;

acquiring at least one image of the one or more gaming objects as settled following the randomization action;

determining one or more gaming object values from the at least one image of the one or more gaming objects; and causing the one or more gaming object values to be displayed on a display device, wherein the randomization action being induced to rotate the one or more gaming objects is imparted using an integral one-piece platform, the platform having a first end portion, a central portion and a second end portion, the first end portion being fixed at an upward angle relative to the central portion, and the second end portion being fixed at an upward angle relative to the central portion, wherein the one or more gaming objects settle at either of the first end portion or the second end portion of the platform, the first end portion and the second end portion being at opposing sides of the platform, and wherein during the randomization action, the platform abruptly moves to cause the gaming object to rotate in a container in a first direction from the first end portion to settle at the second end portion, or alternatively in a second direction from the second end portion to settle at the first end portion.

* * * * *